US009945095B2

(12) United States Patent
Arimatsu et al.

(10) Patent No.: US 9,945,095 B2
(45) Date of Patent: Apr. 17, 2018

(54) CONTROL SYSTEM OF EXCAVATING MACHINE AND EXCAVATING MACHINE

(71) Applicant: Komatsu Ltd., Tokyo (JP)

(72) Inventors: Daiki Arimatsu, Hiratsuka (JP); Azumi Nomura, Fujisawa (JP)

(73) Assignee: Komatsu Ltd., Tokyo (JP)

( * ) Notice: Subject to any disclaimer, the term of this patent is extended or adjusted under 35 U.S.C. 154(b) by 254 days.

(21) Appl. No.: 14/386,456

(22) PCT Filed: Jun. 3, 2014

(86) PCT No.: PCT/JP2014/064788
§ 371 (c)(1),
(2) Date: Sep. 19, 2014

(87) PCT Pub. No.: WO2015/186201
PCT Pub. Date: Dec. 10, 2015

(65) Prior Publication Data
US 2016/0251824 A1 Sep. 1, 2016

(51) Int. Cl.
*G06F 7/70* (2006.01)
*E02F 3/43* (2006.01)
(Continued)

(52) U.S. Cl.
CPC ..... *E02F 3/435* (2013.01); *E02F 9/2025* (2013.01); *E02F 9/2292* (2013.01);
(Continued)

(58) Field of Classification Search
None
See application file for complete search history.

(56) References Cited

U.S. PATENT DOCUMENTS 5,835,874 A 11/1998 Hirata et al.
6,377,872 B1 * 4/2002 Struckman ..... E02F 9/205 342/459
(Continued)

FOREIGN PATENT DOCUMENTS

CN 1651666 A 8/2005
CN 102656323 A 9/2012
(Continued)

OTHER PUBLICATIONS

International Search Report and Written Opinion dated Aug. 26, 2014, issued for PCT/JP2014/064788.
(Continued)

*Primary Examiner* — Adam M Alharbi
(74) *Attorney, Agent, or Firm* — Locke Lord LLP; Howard M. Gitten

(57) ABSTRACT

A control system of an excavating machine controls the excavating machine including a work machine, and includes a communication unit communicating with an outside of the excavating machine and receiving construction information related to an object to be excavated that is excavated by the work machine, a storage unit storing the construction information received by the communication unit, a work machine control unit executing excavation control to control an operation of the work machine not to erode the object to be excavated based on position of the work machine and the construction information stored, and a processing unit determining whether updating construction information to be used by the work machine control unit for the excavation control to the new construction information received by the communication unit according to a control state of the work machine by the work machine control unit.

15 Claims, 12 Drawing Sheets

(51) Int. Cl.

| | |
|---|---|
| ***E02F 9/22*** | (2006.01) |
| ***E02F 9/26*** | (2006.01) |
| ***E02F 9/20*** | (2006.01) |
| *E02F 3/32* | (2006.01) |

(52) U.S. Cl.
CPC ..... *E02F 9/2296* (2013.01); *E02F 9/262* (2013.01); *E02F 9/265* (2013.01); *E02F 3/32* (2013.01)

(56) References Cited

U.S. PATENT DOCUMENTS

| | | | | |
|---|---|---|---|---|
| 9,014,923 | B2 | 4/2015 | Park | |
| 2013/0036089 | A1 * | 2/2013 | Lucas | G06F 17/30283 707/615 |
| 2013/0046447 | A1 | 2/2013 | Park | |
| 2014/0200776 | A1 | 7/2014 | Matsuyama et al. | |

FOREIGN PATENT DOCUMENTS

| | | | |
|---|---|---|---|
| JP | 2013-217138 | A | 10/2013 |
| JP | 2014-055407 | A | 3/2014 |
| WO | WO-95/30059 | A1 | 11/1995 |

OTHER PUBLICATIONS

Chinese Office Action issued by the State Intellectual Property Office of People's Republic of China dated Apr. 28, 2017, in corresponding Chinese Patent Application No. 201480000863.7.

* cited by examiner

CONTROL SYSTEM OF EXCAVATING MACHINE AND EXCAVATING MACHINE

FIELD

The present invention relates to a control system of an excavating machine and an excavating machine.

BACKGROUND

In recent years, in excavating machines including a work machine such as an excavator or a bulldozer, an excavating machine has been proposed, which compares an own position and construction information that indicates a target landform shape from among objects to be excavated, calculates and obtains a posture of the work machine, and controls movement of the work machine not to erode the target landform. Construction by such an excavating machine is called computer-aided construction. For example, Patent Literature 1 describes an excavation control device that can perform excavation, in which a region where a front device can move is restricted.

CITATION LIST

Patent Literature

Patent Literature 1: WO 1995/030059 A

SUMMARY

Technical Problem

By the way, when the construction information that indicates the target landform shape among objects to be excavated is updated while the work machine is controlled not to erode the target landform, the movement of the work machine is controlled based on the updated construction information. Then, the operator does not recognize that the construction information has been updated, and operates the work machine while recognizing the work machine is controlled with respect to the construction information before update. Therefore, the operator may feel uncomfortable.

An objective of the present invention is to provide, in performing computer-aided construction using the excavating machine, a control system of an excavating machine, and an excavating machine, in which unintended construction information for the operator of the excavating machine is not updated, and the operator can operate a work machine without feeling uncomfortable.

Solution to Problem

According to the present invention, a control system of an excavating machine, wherein, during execution of excavation control of controlling an operation of a work machine not to erode an object to be excavated that is excavated by the work machine based on a position of the work machine and construction information indicating a target form of the object to be excavated, when the excavation control is being executed, and in a state of waiting for update to new construction information, the new construction information is not updated for the excavation control that is being executed.

According to the present invention, a control system of controlling an excavating machine including a work machine, the system comprises: a communication unit configured to receive construction information indicating a target form of an object to be excavated that is excavated by the work machine from an external device; a storage unit configured to store the construction information received by the communication unit; a work machine control unit configured to execute excavation control of controlling an operation of the work machine not to erode the object to be excavated based on a position of the work machine and the construction information stored in the storage unit; and a processing unit configured to determine whether updating construction information to be used for the excavation control by the work machine control unit to new construction information received by the communication unit according to a control state of the work machine by the work machine control unit.

In the present invention, it is preferable that when the work machine control unit is executing the excavation control, the processing unit does not update the construction information being used for the excavation control to the new construction information received by the communication unit.

In the present invention, it is preferable that in a case where the work machine control unit is executing the excavation control, when a file name of the construction information being used for the excavation control and a file name of the new construction information received by the communication unit are a same, the processing unit does not update construction information to be used for the excavation control to the new construction information received by the communication unit.

In the present invention, it is preferable that in a case where the work machine control unit is executing the excavation control, when position information of the construction information being used for the excavation control and position information of the new construction information received by the communication unit are a same, the processing unit does not update construction information to be used for the excavation control to the new construction information received by the communication unit.

In the present invention, it is preferable that in a case where the work machine control unit is executing the excavation control, the processing unit updates the construction information other than the construction information being used for the excavation control to the new construction information received by the communication unit.

In the present invention, it is preferable that when the work machine control unit does not execute the excavation control, or the excavating machine is in a state of key-off, the processing unit updates the construction information to be used for the excavation control to the new construction information received by the communication unit.

In the present invention, it is preferable that the control system of an excavating machine comprises: a switch configured to select whether executing the excavation control, wherein when the excavation control is canceled with an operation of the switch after the excavation control is executed with an operation of the switch, the construction information used for the excavation control is updated to the new construction information received by the communication unit.

In the present invention, it is preferable that when the work machine control unit is executing the excavation control, and the work machine is away from the object to be excavated, the processing unit updates the construction information to be used for the excavation control to the new construction information received by the communication unit.

In the present invention, it is preferable that during execution of the excavation control by the work machine control unit, the processing unit displays reception information indicating the communication unit has received the new construction information in a display unit.

According to the present invention, a control system of controlling an excavating machine including a work machine, the system comprises: a communication unit configured to receive, from an external device, construction information that is information related to an object to be excavated that is excavated by the work machine; a storage unit configured to store the construction information received by the communication unit, and to update, when the communication unit has received new construction information, the stored construction information to the new construction information; a work machine control unit configured to execute excavation control of controlling an operation of the work machine not to erode the object to be excavated based on a position of the work machine and the construction information stored in the storage unit; and a processing unit configured to update the construction information to be used by the work machine control unit for the excavation control to the new construction information when the work machine control unit is not executing the excavation control, wherein when the work machine control unit is executing the excavation control, the processing unit is configured not to update the construction information being used by the work machine control unit for the excavation control to the new construction information to update the construction information other than the construction information being used by the work machine control unit for the excavation control to the new construction information received by the communication unit.

According to the present invention, an excavating machine comprises the control system of an excavating machine.

The present invention can provide, in performing computer-aided construction using the excavating machine, a control system of an excavating machine, and an excavating machine, in which unintended construction information for the operator of the excavating machine is not updated, and the operator can operate a work machine without feeling uncomfortable.

DESCRIPTION OF EMBODIMENTS

Embodiments for implementing the present invention will be described in detail with reference to the drawings.

Overall Configuration of Excavating Machine

Figure 1:
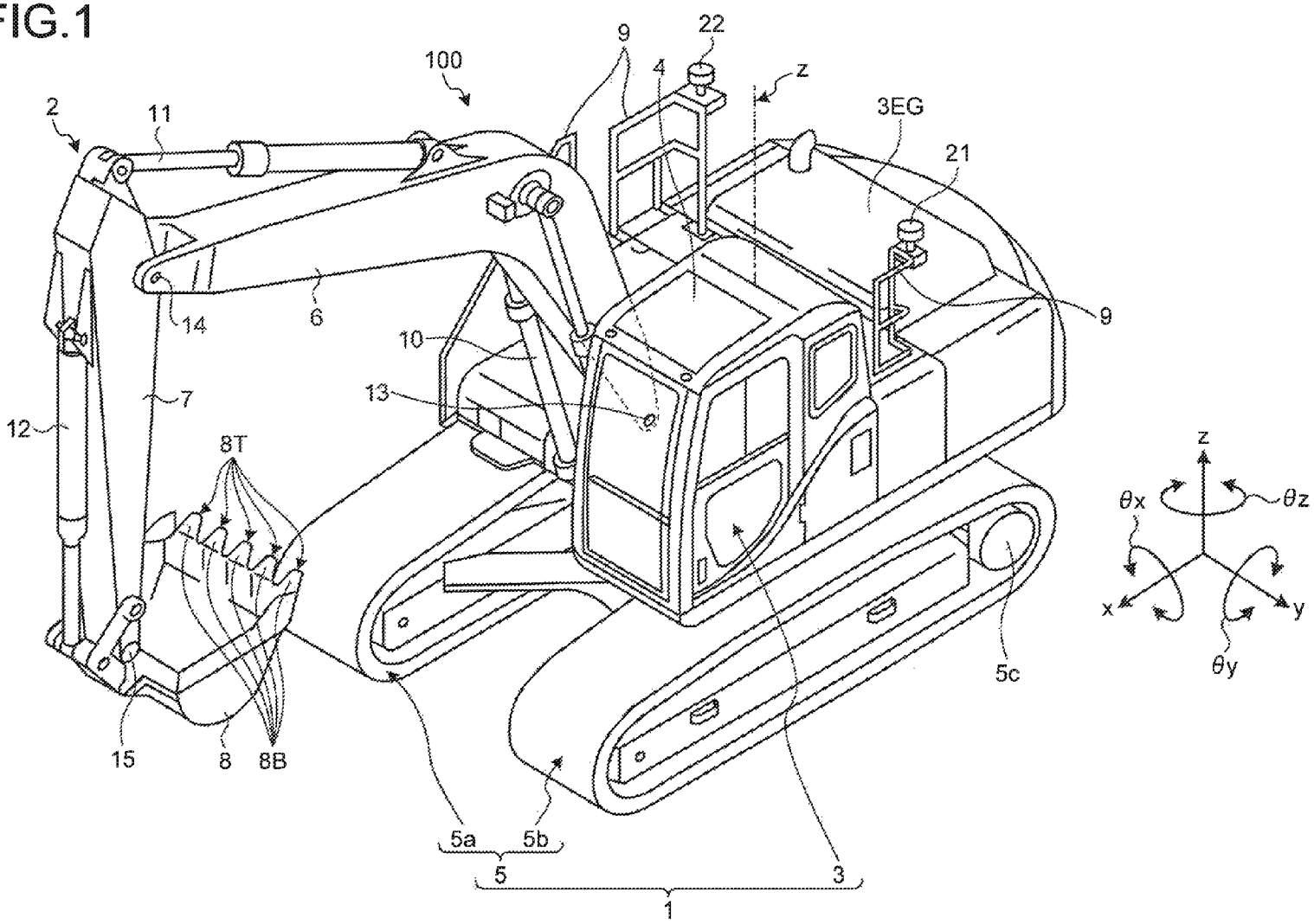
FIG. 1 is a perspective view of an excavator according to the present embodiment.
Figure 2:
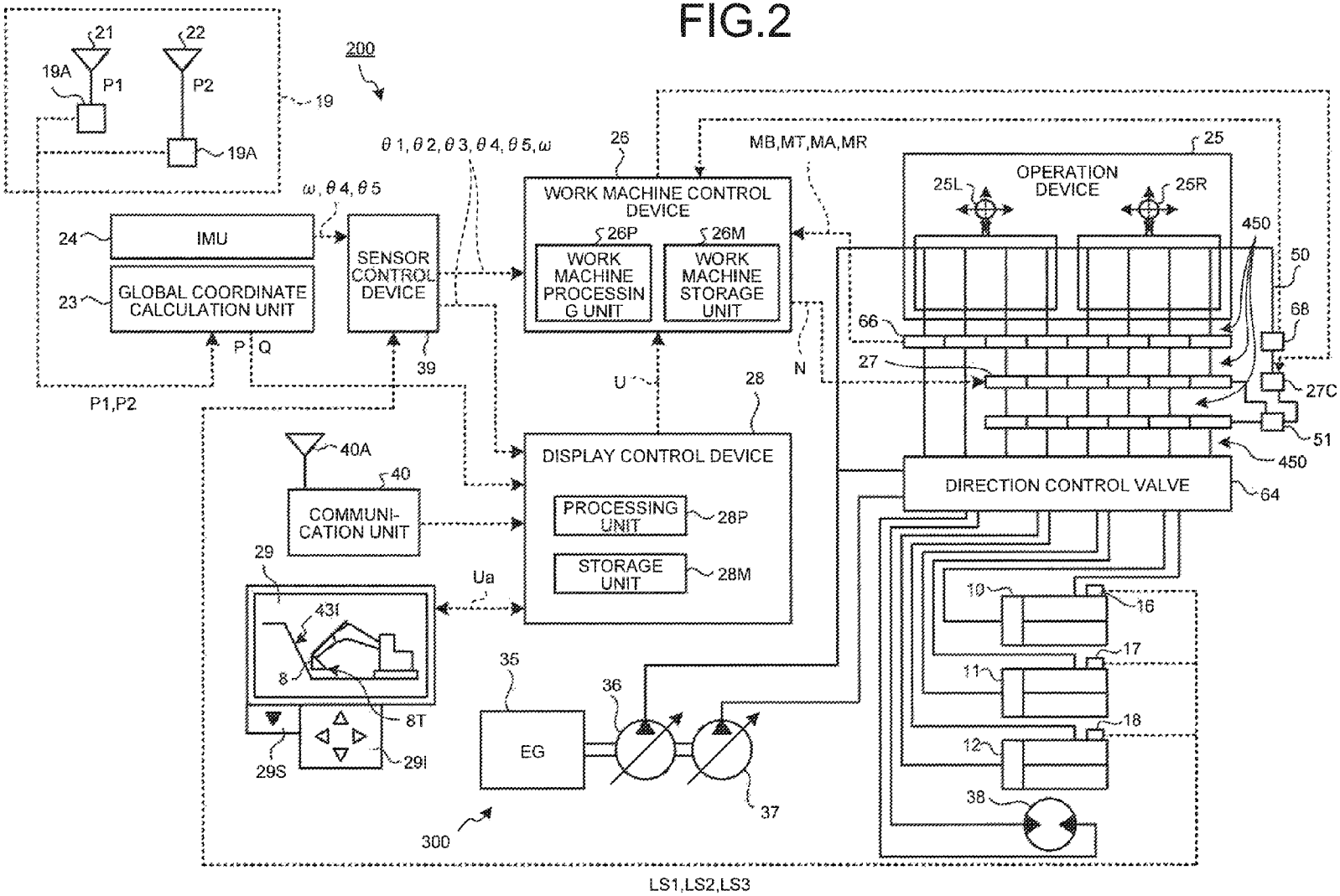
FIG. 2 is a block diagram illustrating a configuration of a hydraulic system and a control system of the excavator.

FIG. 1 is a perspective view of an excavating machine according to an embodiment. FIG. 2 is a block diagram illustrating a configuration of a hydraulic system 300 and a control system 200 of an excavator 100. The excavator 100 as the excavating machine includes a vehicle body 1 as a main body unit and a work machine 2. The vehicle body 1 includes an upper swing body 3 as a swing body and a traveling device 5 as a traveling body. The upper swing body 3 houses devices, such as an engine 35 as a power generation device and hydraulic pumps 36 and 37, and the like inside an engine room 3EG. The engine room 3EG is arranged at one end of the upper swing body 3.

In the present embodiment, the excavator 100 uses an internal-combustion engine, such as a diesel engine, as the engine 35 as a power generation device. However, the power generation device is not limited thereto. The power generation device of the excavator 100 may be a so-called hybrid-system device that is a combination of an internal-combustion engine, a generator motor, and a storage device. Further, the power generation device of the excavator 100 may be an electrically-driven type device that is a combination of a generator motor and a storage device without including an internal-combustion engine.

The upper swing body 3 includes an operator cab 4. The operator cab 4 is installed at the other end side of the upper swing body 3. That is, the operator cab 4 is installed at a side opposite to the side where the engine room 3EG is installed. Inside the operator cab 4, a display unit 29 and an operation device 25 as illustrated in FIG. 2, and a driver's seat (not illustrated), and the like are arranged. These devices will be described below. Handrails 9 are attached to upper portions of the upper swing body 3.

The traveling device 5 mounts the upper swing body 3. The traveling device 5 includes caterpillar bands 5*a* and 5*b*. One or both of travel motors 5*c* provided at right and left sides of the traveling device 5 is (are) driven, and the caterpillar bands 5*a* and 5*b* are turned, so that the excavator 100 is allowed to swing to travel or travel backward and forward. The work machine 2 is attached to the upper swing body 3 at the side of the operator cab 4.

The excavator 100 may include tires instead of the caterpillar bands 5*a* and 5*b*, and may include a traveling device capable of traveling by transmitting driving force of the engine 35 to the tires through a transmission. An example of such an excavator 100 includes a wheel-type excavator. Further, the excavator 100 may be a backhoe loader including such a traveling device having tires, and further including a structure in which a work machine is attached to the vehicle body (main body unit), and the upper swing body 3 as illustrated in FIG. 1 and a swing mechanism thereof are not included. That is, the backhoe loader has the work machine attached to the vehicle body and a traveling device that constitutes a part of the vehicle body.

In the upper swing body 3, the side where the work machine 2 and the operator cab 4 are arranged is a front side, and the side where the engine room 3EG is arranged is a back side. That is, in the present embodiment, the front and back direction is an x direction. Facing front, the left side is a left side of the upper swing body 3, and the right side is a right side of the upper swing body 3. The right and left direction of the upper swing body 3 is also called width direction. That is, in the present embodiment, the right and left direction is a y direction. In the excavator 100 or the vehicle body 1, the side of the traveling device 5 is a downside based on the upper swing body 3, and the side of the upper swing body 3 is an upside based on the traveling device 5. That is, in the present embodiment, the up and down direction is a z direction. In a case where the excavator 100 is installed on a horizontal plane, the downside is a vertical direction, that is, in the direction of action of gravity, and the upside is in a direction opposite to the vertical direction.

The work machine 2 includes a boom 6, an arm 7, a bucket 8 as a working tool, a boom cylinder 10, an arm cylinder 11, and a bucket cylinder 12. A base end portion of the boom 6 is revolvably attached to a front portion of the upper swing body 3 of the vehicle body 1 through a boom pin 13. A base end portion of the arm 7 is revolvably attached to a tip portion of the boom 6 via an arm pin 14. The bucket 8 is attached to a tip portion of the arm 7 through a bucket pin 15, the tip portion being at a side opposite to the base end portion. The bucket 8 revolves around the bucket pin 15. A plurality of blades 8B is attached to the bucket 8 at an opposite side to the bucket pin 15. A blade tip 8T is a tip of the blade 8B.

The bucket 8 may not include the plurality of blades 8B. That is, the bucket 8 may be a bucket that does not include the blades 8B as illustrated in FIG. 1, and in which the blade tip is formed into a straight shape with a steel plate. The work machine 2 may include a tilt bucket having a single blade. The tilt bucket is a bucket that includes a tilt cylinder, and with which a slope or a level ground can be formed and leveled into a free form even if the excavator 100 is on a slope land in such a way that the bucket is tilted leftward and rightward. In addition, the work machine 2 may include a slope bucket or a drilling attachment including a drilling chip, or the like, instead of the bucket 8.

The boom cylinder 10, the arm cylinder 11, and the bucket cylinder 12 illustrated in FIG. 1 are hydraulic cylinders extended/contracted and driven by working oil. The boom cylinder 10 is extended/contracted to drive and move the boom 6 up and down. The arm cylinder 11 is extended/contracted to cause the arm 7 to revolve using the arm pin 14 as a supporting point. The bucket cylinder 12 is extended/contracted to cause the bucket 8 to revolve through a link using the bucket pin 15 as a supporting point. When the boom cylinder 10, the arm cylinder 11, and the bucket cylinder 12 are collectively called without being distinguished, they are appropriately called hydraulic cylinders 10, 11, and 12.

A direction control valve 64 illustrated in FIG. 2 is provided between the hydraulic cylinders such as the boom cylinder 10, the arm cylinder 11, and the bucket cylinder 12, and the hydraulic pumps 36 and 37 illustrated in FIG. 2. The direction control valve 64 controls a flow rate of the working oil supplied from the hydraulic pumps 36 and 37 to the boom cylinder 10, the arm cylinder 11, the bucket cylinder 12, and the like, and switches a direction into which the working oil flows. With the control of the flow rate of the working oil, extension/contraction amounts of the hydraulic cylinders 10, 11, and 12 are controlled, and with the switching control of the direction into which the working oil flows, switching control for causing the hydraulic cylinders 10, 11, and 12 to perform an extension operation and a contraction operation is performed. The direction control valve 64 includes a travel direction control valve for driving a travel motor 5*c*, and a work machine direction control valve for controlling the boom cylinder 10, the arm cylinder 11, the bucket cylinder 12, and a swing motor 38 that causes the upper swing body 3 to swing.

In the present embodiment, the operation device 25 employs a pilot hydraulic pressure system. The working oil depressurized to a predetermined pilot hydraulic pressure by a depressurizing valve (not illustrated) is supplied from the hydraulic pump 36 to the operation device 25 based on a boom operation, a bucket operation, an arm operation, and a swing operation. When the working oil adjusted to the predetermined pilot hydraulic pressure and supplied from the operation device 25 operates a spool (not illustrated) of the direction control valve 64, the flow rate of the working oil flowing through the direction control valve 64 is adjusted, and the flaw rate of the working oil supplied from the hydraulic pumps 36 and 37 to the boom cylinder 10, the arm cylinder 11, the bucket cylinder 12, the swing motor 38, or the travel motor 5*c* is adjusted. As a result, operations of the boom cylinder 10, the arm cylinder 11, the bucket cylinder 12, and the like are controlled.

Further, a work machine control device 26 illustrated in FIG. 2 controls control valves 27 illustrated in FIG. 2, so that the pilot hydraulic pressure of the working oil supplied from the operation device 25 to the direction control valve 64 is controlled. Therefore, the flow rate of the working oil supplied from the direction control valve 64 to the boom cylinder 10, the arm cylinder 11, and the bucket cylinder 12 is controlled. As a result, the work machine control device 26 can control the operations of the boom cylinder 10, the arm cylinder 11, the bucket cylinder 12, and the like.

Antennas 21 and 22 are attached to upper portions of the upper swing body 3. The antennas 21 and 22 are used for detecting a current position of the excavator 100. The antennas 21 and 22 are a part of a position detection unit 19 illustrated in FIG. 2 for detecting a current position of the excavator 100, and are electrically connected with position detection devices 19A. The position detection device 19A functions as a three-dimensional position sensor, and detects the current position of the excavator 100 using a real time kinematic-global navigation satellite system (RTK-GNSS). In the following description, the antennas 21 and 22 are appropriately referred to as GNSS antennas 21 and 22. Signals according to GNSS radio waves received by the GNSS antennas 21 and 22 are input to the position detection devices 19A. The position detection devices 19A detect installation positions of the GNSS antennas 21 and 22. The position detection unit 19A includes a three-dimensional position sensor, for example.

The GNSS antennas 21 and 22 are favorably installed on the upper swing body 3 and at both end positions of the excavator 100, the positions being separated from each other in the right and left direction, as illustrated in FIG. 1. In the present embodiment, the GNSS antennas 21 and 22 may be attached to the handrails 9 attached to both sides of the upper swing body 3 in the right and left width direction, respectively. The positions of the GNSS antennas 21 and 22 attached to the upper swing body 3 are not limited to the handrails 9. However, if the GNSS antennas 21 and 22 are installed at positions separated from each other as far as possible, detection accuracy of the current position of the excavator 100 is improved, and thus it is favorable. Further, it is favorable to install the GNSS antennas 21 and 22 at positions not to hinder the view of the operator.

As illustrated in FIG. 2, the hydraulic system 300 of the excavator 100 includes the engine 35 as a power generation source and the hydraulic pumps 36 and 37. The hydraulic pumps 36 and 37 are driven by the engine 35 and discharge the working oil. The working oil discharged from the hydraulic pumps 36 and 37 is supplied to the boom cylinder 10, the arm cylinder 11, and the bucket cylinder 12. Further, the excavator 100 includes the swing motor 38. The swing motor 38 is a hydraulic motor, and is driven by the working oil discharged from the hydraulic pumps 36 and 37. The swing motor 38 causes the upper swing body 3 to swing. Note that, while, in FIG. 2, the two hydraulic pumps 36 and 37 are illustrated, only one hydraulic pump may be provided. As the swing motor 38, an electric motor may be used, instead of a hydraulic motor. Alternatively, the swing motor 38 may have a configuration, in which a hydraulic motor and an electric motor are integrated, the electric motor generates power when the upper swing body 3 swings while reducing the speed and stores the electrical energy into a secondary battery or the like, and the electric motor assists the hydraulic motor when the upper swing body 3 swings while increasing a speed.

The control system 200 as a control system of the excavating machine includes the position detection unit 19, a global coordinate calculation unit 23, an inertial measurement unit (IMU) 24 as a detection device that detects an angle speed and acceleration, the operation device 25, the work machine control device 26 as a work machine control unit, a sensor control device 39, a display control device 28 as a setting unit, a display unit 29, a communication unit 40, and further stroke sensors 16, 17, and 18. The operation device 25 is a device for operating an operation of the work machine 2 and swing of the upper swing body 3 illustrated in FIG. 1. When the work machine 2 is operated by the operation device 25, the working oil according to an operation amount is supplied to the hydraulic cylinders 10, 11, and 12, or the swing motor 38 upon receiving an operation from the operator.

For example, the operation device 25 includes a left operation lever 25L installed on the left side as viewed from the operator when the operator sits on the driver's seat, and a right operation lever 25R arranged on the right side as viewed from the operator. Front and back, and right and left operations of the left operation lever 25L and the right operation lever 25R correspond to operations of two axes. For example, operations of the right operation lever 25R in the front and back direction correspond to operations of the boom 6. When the right operation lever 25R is operated forward, the boom 6 is lowered, and when operated backward, the boom 6 is raised. That is, raising and lowering operations of the boom 6 are executed according to the operations of the right operation lever 25R in the front and back direction. Operations of the right operation lever 25R in the right and left direction correspond to operations of the bucket 8. When the right operation lever 25R is operated leftward, the bucket 8 performs an excavating operation, and when operated rightward, the bucket 8 performs soil removing (dumping). That is, excavation and soil removing operation of the bucket 8 are executed according to the operations of the right operation lever 25R in the right and left direction. Operations of the left operation lever 25L in the front and back direction correspond to operations of the arm 7. When the left operation lever 25L is operated forward, the arm 7 performs soil removing (dumping), and when operated backward, the arm 7 performs an excavating operation. The operations of the left operation lever 25L in the right and left direction correspond to swing of the upper swing body 3. When the left operation lever 25L is operated leftward, the upper swing body 3 swings leftward, and when operated rightward, the upper swing body 3 swings rightward. The above-described relationship between the operating directions of the operation levers 25R and 25L and the movement of the work machine 2 and the upper swing body 3 are exemplarily illustrated. Therefore, relationship between the operating directions of the operation levers 25R and 25L and the movement of the work machine 2 and the upper swing body 3 may be a different relationship from the above-described relationship. Note that a travel operation device for operating the traveling device 5 illustrated in FIG. 1 is provided inside the operator cab 4. The travel operation device is configured from a lever, for example, and is arranged in front of the driver's seat (not illustrated). When the operator operates the lever, the traveling device 5 is driven to enable the excavator 100 to perform swing traveling or traveling forward or backward.

The pilot hydraulic pressure becomes suppliable to a pilot oil passage 450 according to the operations of the right operation lever 25R in the front and back direction, and an operation of the boom 6 by the operator is accepted. A valve device included in the right operation lever 25R is opened according to an operation amount of the right operation lever 25R, and the working oil is supplied to the pilot oil passage 450. Further, a pressure sensor 66 detects a pressure of the working oil in the pilot oil passage 450 at that time as the pilot hydraulic pressure. The pressure sensor 66 transmits the detected pilot hydraulic pressure to the work machine control device 26 as a boom operation amount MB. The operation amount of the right operation lever 25R in the front and back direction will be hereinafter appropriately referred to as boom operation amount MB. To the pilot oil passage 50 between the operation device 25 and the boom cylinder 10, a pressure sensor 68, a control valve (hereinafter, appropriately referred to as intervention valve) 27C, and a shuttle valve 51 are provided. The intervention valve 27C and the shuttle valve 51 will be described below.

The pilot hydraulic pressure becomes suppliable to the pilot oil passage 450 according to the operations of the right operation lever 25R in the right and left direction, and an operation of the bucket 8 by the operator is accepted. The valve device included in the right operation lever 25R is opened according to the operation amount of the right operation lever 25R, and the working oil is supplied to the pilot oil passage 450. Further, the pressure sensor 66 detects a pressure of the working oil in the pilot oil passage 450 at that time as the pilot hydraulic pressure. The pressure sensor 66 transmits the detected pilot hydraulic pressure to the work machine control device 26 as a bucket operation amount MT. The operation amount of the right operation lever 25R in the right and left direction will be hereinafter appropriately referred to as bucket operation amount MT.

The pilot hydraulic pressure becomes suppliable to the pilot oil passage 450 according to the operations of the left operation lever 25L in the front and back direction, and an operation of the arm 7 by the operator is accepted. A valve device included in the left operation lever 25L is opened according to an operation amount of the left operation lever 25L, and the working oil is supplied to the pilot oil passage 450. Further, the pressure sensor 66 detects a pressure of the working oil in the pilot oil passage 450 at that time as the pilot hydraulic pressure. The pressure sensor 66 transmits the detected pilot hydraulic pressure to the work machine control device 26 as an arm operation amount MA. The operating amount of the left operation lever 25L in the front and back direction will be hereinafter appropriately referred to as the arm operation amount MA.

The pilot hydraulic pressure becomes suppliable to the pilot oil passage 450 according to the operations of the left operation lever 25L in the left and left direction, and an operation of the upper swing body 3 by the operator is accepted. The valve device included in the left operation lever 25L is opened according to the operation amount of the left operation lever 25L, and the working oil is supplied to the pilot oil passage 450. Further, the pressure sensor 66 detects a pressure of the working oil in the pilot oil passage 450 at that time as the pilot hydraulic pressure. The pressure sensor 66 transmits the detected pilot hydraulic pressure to the work machine control device 26 as a swing operation amount MR. The operating amount of the left operation lever 25L in the right and left direction will be hereinafter appropriately referred to as the swing operation amount MR.

With the operation of the right operation lever 25R, the operation device 25 supplies the pilot hydraulic pressure having magnitude according to the operation amount of the right operation lever 25R to the direction control valve 64. With the operation of the left operation lever 25L, the operation device 25 supplies the pilot hydraulic pressure having magnitude according to the operation amount of the left operation lever 25L to the direction control valve 64. With the pilot hydraulic pressure, the spool of the direction control valve 64 is operated.

The control valves 27 are provided in the pilot oil passage 450. The operation amounts of the right operation lever 25R and the left operation lever 25L are detected by the pressure sensor 66 installed at the pilot oil passage 450. A signal of the pilot hydraulic pressure detected by the pressure sensor 66 is input to the work machine control device 26. The work machine control device 26 outputs a control signal N with respect to the pilot oil passage 450 according to the input pilot hydraulic pressure to the control valves 27. The control valves 27 that have received the control signal N open/close the pilot oil passage 450.

The operation amounts of the left operation lever 25L and the right operation lever 25R are detected by a potentiometer and a Hall IC, for example, and the work machine control device 26 may control the direction control valve 64 and the control valves 27 based on detection values, and thereby to control the work machine 2 and the swing motor 38. As described above, the left operation lever 25L and the right operation lever 25R may employ an electrical system.

The control system 200 includes the first stroke sensor 16, the second stroke sensor 17, and the third stroke sensor 18, as described above. For example, the first stroke sensor 16 is provided to the boom cylinder 10, the second stroke sensor 17 is provided to the arm cylinder 11, and the third stroke sensor 18 is provided to the bucket cylinder 12, respectively. Each of the stroke sensors 16, 17, and 18 can use a rotary encoder that detects extension/contraction of a cylinder rod (not illustrated), for example. However, a distance sensor may be used.

The first stroke sensor 16 detects a stroke length LS1 of the boom cylinder 10. To be specific, the first stroke sensor 16 detects an extension/contraction amount of the cylinder rod of the boom cylinder 10. The first stroke sensor 16 detects a displacement amount corresponding to the extension/contraction of the boom cylinder 10 and outputs the detected amount to the sensor control device 39. The sensor control device 39 calculates a cylinder length of the boom cylinder 10 (hereinafter, appropriately referred to as boom cylinder length) corresponding to the displacement amount of the first stroke sensor 16. The sensor control device 39 calculates, from the calculated boom cylinder length, inclination angle θ1 (see FIG. 3A) of the boom 6 with respect to a direction (z axis direction) perpendicular to a horizontal plane in a local coordinate system of the excavator 100, to be specific, in a local coordinate system of the vehicle body 1, and outputs the calculated angle to the work machine control device 26 and the display control device 28.

The second stroke sensor 17 detects a stroke length LS2 of the arm cylinder 11. To be specific, the second stroke sensor 17 detects an extension/contraction amount of the cylinder rod of the arm cylinder 11. The second stroke sensor 17 detects a displacement amount corresponding to the extension/contraction of the arm cylinder 11, and outputs the detected amount to the sensor control device 39. The sensor control device 39 calculates a cylinder length of the arm cylinder 11 (hereinafter, appropriately referred to as arm cylinder length) corresponding to the displacement amount of the second stroke sensor 17.

The sensor control device 39 calculates, from the arm cylinder length detected by the second stroke sensor 17, an inclination angle θ2 (see FIG. 3A) of the arm 7 with respect to the boom 6, and outputs the calculated angle to the work machine control device 26 and the display control device 28. The third stroke sensor 18 detects a stroke length LS3 of the bucket cylinder 12. To be specific, the third stroke sensor 18 detects an extension/contraction amount of the cylinder rod of the bucket cylinder 12. The third stroke sensor 18 detects a displacement amount corresponding to the extension/contraction of the bucket cylinder 12, and outputs the detected amount to the sensor control device 39. The sensor control device 39 calculates a cylinder length of the bucket cylinder 12 (hereinafter, appropriately referred to as bucket cylinder length) corresponding to the displacement amount of the third stroke sensor 18.

The sensor control device 39 calculates, from the bucket cylinder length detected by the third stroke sensor 18, an inclination angle θ3 (see FIG. 3A) of the blade tip 8T of the bucket 8 included in the bucket 8 with respect to the arm 7, and outputs the calculated angle to the work machine control device 26 and the display control device 28. The inclination angle θ1 of the boom 6, the inclination angle θ2 of the arm 7, and the inclination angle θ3 of the bucket 8 may be obtained by the rotary encoder attached to the boom 6 and measuring the inclination angle of the boom 6, the rotary encoder attached to the arm 7 and measuring the inclination angle of the arm 7, and the rotary encoder attached to the bucket 8 and measuring the inclination angle of the bucket 8, other than by being measured with the first stroke sensor 16, and the like.

The work machine control device 26 includes a work machine storage unit 26M such as a random access memory (RAM) and a read only memory (ROM), and a work machine processing unit 26P such as a central processing unit (CPU), and the like. The work machine control device 26 controls the control valves 27 and the intervention valve 27C based on the detection values of the pressure sensor 66 illustrated in FIG. 2.

The direction control valve 64 illustrated in FIG. 2 is a proportional control value, for example, and is controlled by the working oil supplied from the operation device 25. The direction control valve 64 is arranged between the hydraulic actuators such as the boom cylinder 10, the arm cylinder 11, the bucket cylinder 12, and the swing motor 38, and the hydraulic pumps 36 and 37. The direction control valve 64 controls the flow rate of the working oil supplied from the hydraulic pumps 36 and 37 to the boom cylinder 10, the arm cylinder 11, the bucket cylinder 12, and the swing motor 38.

The position detection unit 19 included in the control system 200 detects the position of the excavator 100. The position detection unit 19 includes the above-described GNSS antennas 21 and 22. A signal according to the GNSS radio wave received by the GNSS antennas 21 and 22 is input to the global coordinate calculation unit 23. The GNSS antenna 21 receives a reference position data P1 that indicates an own position from a positioning satellite. The GNSS antenna 22 receives a reference position data P2 that indicates an own position from a positioning satellite. The GNSS antennas 21 and 22 receive the reference position data P1 and P2 at a predetermined cycle. The reference position data P1 and P2 are information of the positions where the GNSS antennas 21 and 22 are installed. The GNSS antennas 21 and 22 and the position detection unit 19 output the reference position data P1 and P2 to the global coordinate calculation unit 23 every time receiving the data.

The global coordinate calculation unit 23 acquires the two reference position data P1 and P2 (a plurality of reference position data) expressed in the global coordinate system. The global coordinate calculation unit 23 generates swing body arrangement data that indicates arrangement of the upper swing body 3 based on the two reference position data P1 and P2. In the present embodiment, the swing body arrangement data includes one reference position data P of the two reference position data P1 and P2, and swing body azimuth data Q generated based on the two reference position data P1 and P2. The swing body azimuth data Q is determined based on an angle made by the azimuth determined from the reference position data P acquired by the GNSS antennas 21 and 22 with respect to a reference azimuth (for example, north) of the global coordinates. The swing body azimuth data Q indicates an azimuth into which the upper swing body 3, that is, the work machine 2 faces. The global coordinate calculation unit 23 updates the swing body arrangement data, that is, the reference position data P and the swing body azimuth data Q, and outputs the updated data to the display control device 28 every time acquiring the two reference position data P1 and P2 from the GNSS antennas 21 and 22 with a predetermined frequency.

The IMU 24 is attached to the upper swing body 3. The IMU 24 detects operation data that indicates an operation of the upper swing body 3. The operation data detected by the IMU 24 is acceleration and an angle speed (swing angle speed ω). The IMU 24 may output a role angle (inclination angle θ4) or a pitch angle (inclination angle θ5) of the excavator 100. In the present embodiment, the operation data is the swing angle speed ω at which the upper swing body 3 swings around a swing axis z of the upper swing body 3 illustrated in FIG. 1.

Figure 3A:
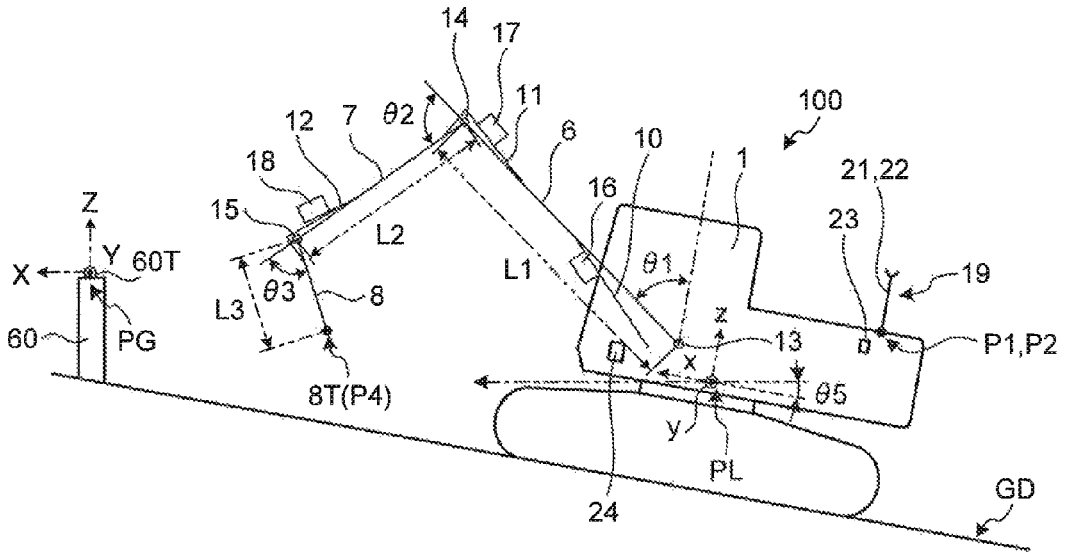
FIG. 3A is a side view of the excavator.
Figure 3B:
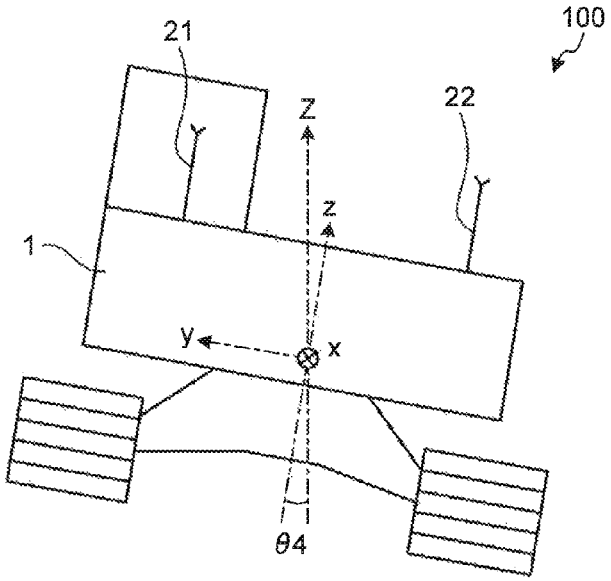
FIG. 3B is a back view of the excavator.

FIG. 3A is a side view of the excavator 100. FIG. 3B is a back view of the excavator 100. The IMU 24 detects, as illustrated in FIGS. 3A and 3B, the inclination angle θ4 that is a roll angle of the vehicle body 1 in the right and left direction, the inclination angle θ5 that is a pitch angle of the vehicle body 1 in the front and back direction, the acceleration, and the angle speed (swing angle speed ω). The IMU 24 updates the swing angle speed ω, the inclination angle θ4, and the inclination angle θ5 with a predetermined frequency. An updating cycle in the IMU 24 is favorably shorter than an updating cycle in the global coordinate calculation unit 23. The swing angle speed ω, the inclination angle θ4, and the inclination angle θ5 detected by the IMU 24 are output to the sensor control device 39. The sensor control device 39 applies filtering processing and the like to the swing angle speed ω, the inclination angle θ4, and the inclination angle θ5, and then outputs the processed data to the work machine control device 26 and the display control device 28.

The display control device 28 acquires the swing body arrangement data (the reference position data P and the swing body azimuth data Q) from the global coordinate calculation unit 23. In the present embodiment, the display control device 28 generates bucket blade tip position data S that indicates a three-dimensional position of the blade tip 8T of the bucket 8 as work machine position data. The display control device 28 then generates target excavation landform data U as information indicating a target form of an object to be excavated using the bucket blade tip position data S and target construction information T described below. The display control device 28 derives display target excavation landform data Ua based on the target excavation landform data U, and displays target excavation landform 43I in the display unit 29 based on the display target excavation landform data Ua. In the present embodiment, the display control device 28 stores design surface information T received and acquired by the communication unit 40 from an outside of the excavator 100 by wireless communication through an antenna 40A in a storage unit 28M. Design surface information TI includes target construction information T described below, which will be hereinafter appropriately referred to as target construction information T. The design surface information TI is information related to an object to be excavated that is excavated by the work machine 2. The information related to the object to be excavated includes, to be specific, construction information (target construction information T) that indicates a target form of the object to be excavated. The design surface information TI may include information related to a landform shape of a portion that does not need to be constructed by the excavator 100. Meanwhile, the design surface information TI may include only the information related to a landform shape of a portion that needs to be excavated by construction, that is, only the construction information that indicates the target form, and the design surface information TI and the target construction information T are the same. The communication unit 40 may acquire the target construction information T from an outside of the excavator 100 by wired communication or wired connection as described below. Details of the target construction information T will be described below.

The display unit 29 is, but not limited to, a liquid crystal display device, or the like, and a touch panel may be used. In the present embodiment, a switch 29S and an input unit 29I are installed adjacent to the display unit 29. The switch 29S is an input device for selecting whether excavation control described below is executed. When a touch panel is used for the display unit 29, the switch 29S and the input unit 29I are integrated, and by touching of the display unit 29, functions allocated to the switch 29S and the input unit 29I work. The input unit 29I is used for selecting a target construction surface including the target excavation landform 43I to be displayed in the display unit 29, or selecting a range of the target construction surface that is to be an object of excavation control described below, by the operator of the excavator 100.

The work machine control device 26 acquires the swing angle speed ω that indicates a swing speed at which the upper swing body 3 swings around the swing axis z illustrated in FIG. 1 from the sensor control device 39. Further, the work machine control device 26 acquires the boom operation amount MB, the bucket operation amount MT, the arm operation amount MA, and the swing operation amount MR, and signals indicating the above amounts from the pressure sensor 66. Further, the work machine control device 26 acquires work machine angles such as the inclination angle θ1 of the boom 6, the inclination angle θ2 of the arm 7, and the inclination angle θ3 of the bucket 8, and vehicle body inclination angles such as the inclination angle θ4 and the inclination angle θ5 from the sensor control device 39.

The work machine control device 26 acquires the target excavation landform data U from the display control device 28. The work machine control device 26 calculates a position of the blade tip 8T (hereinafter, appropriately referred to as blade tip position) of the bucket 8 from the work machine angles and the vehicle body inclination angles acquired from the sensor control device 39. The work machine control device 26 adjusts the boom operation amount MB, the bucket operation amount MT, and the arm operation amount MA input from the operation device 25 based on a distance between the target excavation landform data U and the blade tip 8T of the bucket 8, and the speed of the work machine 2 so that the blade tip 8T of the bucket 8 is moved along the target excavation landform data U not to dig into and erode the target excavation landform data U. The work machine control device 26 generates the control signal N for controlling the work machine 2 so that the blade tip 8T of the bucket 8 is moved along the target excavation landform data U, and outputs the signal to the control valves 27 illustrated in FIG. 2. With such processing, the speed of the work machine 2 to approach the target excavation landform data U is controlled according to the distance to the target excavation landform data U.

Two each of the control valves 27 provided to each of the boom cylinder 10, the arm cylinder 11, and the bucket cylinder 12 are opened/closed according to the control signal N output from the work machine control device 26. The spool of the direction control valve 64 is operated based on the operation of the left operation lever 25L or the right operation lever 25R, and an open/close command from the control valves 27, and the working oil supplied to the boom cylinder 10, the arm cylinder 11, and the bucket cylinder 12 is adjusted.

The global coordinate calculation unit 23 detects the reference position data P1 and P2 of the GNSS antennas 21 and 22 in the global coordinate system. The global coordinate system is a three-dimensional coordinate system indicated by (X, Y, Z) based on a reference position PG of a reference post 60 as a reference, which serves as a reference installed in a work area GD of the excavator 100. As illustrated in FIG. 3A, the reference position PG is positioned at a tip 60T of the reference post 60 installed in the work area GD. In the present embodiment, the global coordinate system is a coordinate system in the GNSS.

The display control device 28 illustrated in FIG. 2 calculates a position of the local coordinate system as viewed in the global coordinate system based on a detection result of the position detection unit 19. The local coordinate system is a three-dimensional coordinate system indicated by (x, y, z) using the excavator 100 as a reference. In the present embodiment, a reference position PL of the local coordinate system is positioned on a swing circle for the upper swing body 3 swinging. In the present embodiment, the work machine control device 26 calculates the position of the local coordinate system as viewed in the global coordinate system as follows.

The sensor control device 39 calculates the inclination angle θ1 of the boom 6 with respect to a direction (z axis direction) perpendicular to a horizontal plane in the local coordinate system from the boom cylinder length detected by the first stroke sensor 16. The sensor control device 39 calculates the inclination angle θ2 of the arm 7 with respect to the boom 6 from the arm cylinder length detected by the second stroke sensor 17. The sensor control device 39 calculates the inclination angle θ3 of the bucket 8 with respect to the arm 7 from the bucket cylinder length detected by the third stroke sensor 18.

The work machine storage unit 26M of the work machine control device 26 stores data of the work machine 2 (hereinafter, appropriately referred to as work machine data). The work machine data includes a length L1 of the boom 6, a length L2 of the arm 7, and a length L3 of the bucket 8. As illustrated in FIG. 3A, the length L1 of the boom 6 corresponds to a length from the boom pin 13 to the arm pin 14. The length L2 of the arm 7 corresponds to a length from the arm pin 14 to the bucket pin 15. The length L3 of the bucket 8 corresponds to a length from the bucket pin 15 to the blade tip 8T of the bucket 8. The blade tip 8T is a tip of the blade 8B illustrated in FIG. 1. Further, the work machine data includes position information of the reference position PL of the local coordinate system to the boom pin 13.

Figure 4:
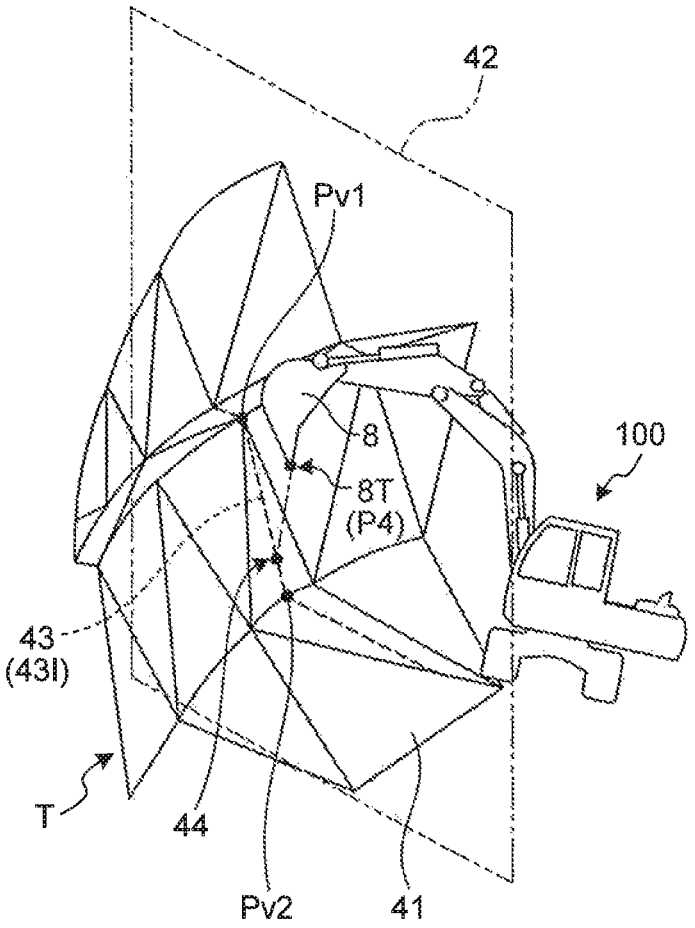
FIG. 4 is a schematic diagram illustrating an example of construction information indicating a target form of an object to be excavated.

FIG. 4 is a schematic diagram illustrating an example of construction information indicating a target form of an object to be excavated. As illustrated in FIG. 4, the target construction information T that is an object to be excavated by the work machine 2 included in the excavator 100, and a finish target of the object to be excavated after the excavation includes a plurality of target construction surfaces 41 respectively expressed by triangular polygons. The target construction information T may configure construction information that indicates a target form of an object to be excavated by information that indicates at least one of lines or points, instead of the information related to the surfaces like the target construction surface 41. That is, the target construction information T may just be construction information that indicates a target form of an object to be excavated by information including at least one form of surfaces, lines, and points. In FIG. 4, only one of the plurality of target construction surfaces 41 is denoted with the reference sign 41, and reference signs of other target construction surfaces 41 are omitted. The work machine control device 26 controls the speed of the work machine 2 in a direction into which the work machine 2 comes close to the object to be excavated to be a speed limit or less so as to suppress the bucket 8 from eroding the target excavation landform data Ua, that is, the target excavation landform 43I. This control is appropriately referred to as excavation control. Next, the excavation control executed by the work machine control device 26 will be described.

<Excavation Control>

Figure 5:
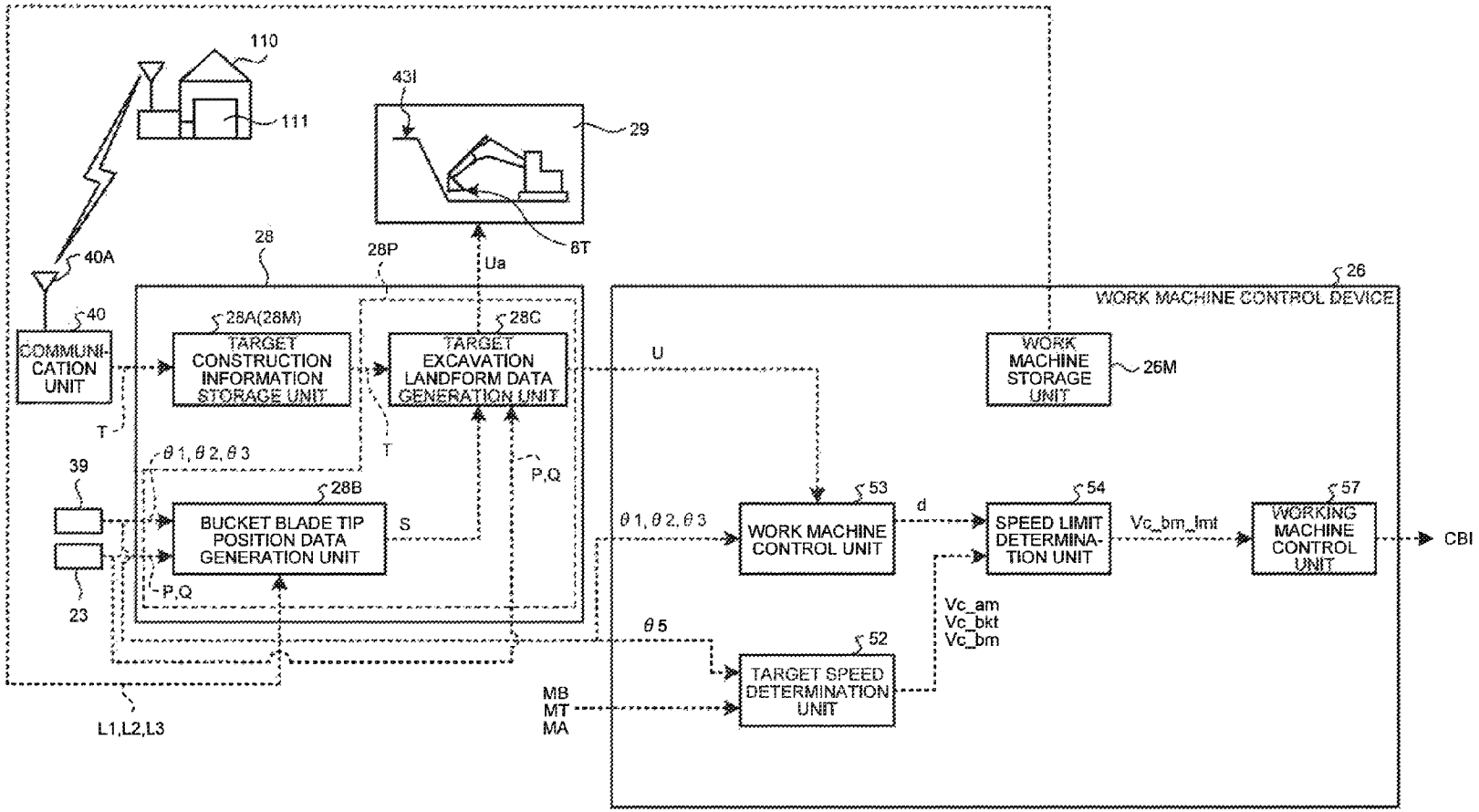
FIG. 5 is a block diagram illustrating a work machine controller and a display controller.
Figure 6:
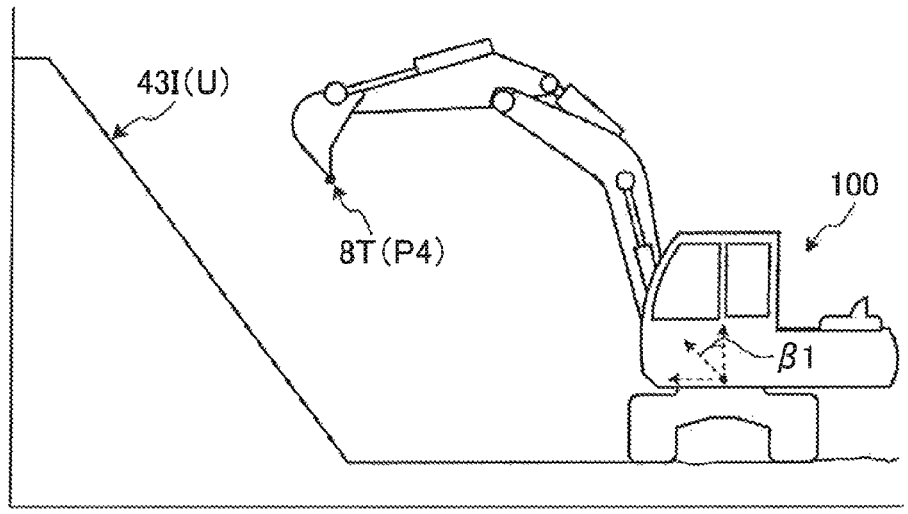
FIG. 6 is a diagram illustrating an example of a target excavation landform displayed in a display unit.
Figure 7:
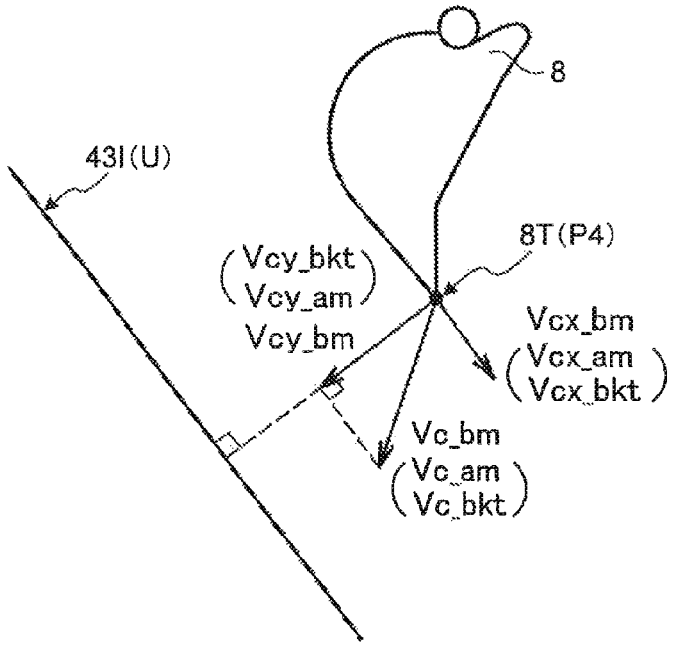
FIG. 7 is a schematic diagram illustrating a relationship among a target speed, a vertical speed component, and a horizontal speed component.
Figure 8:
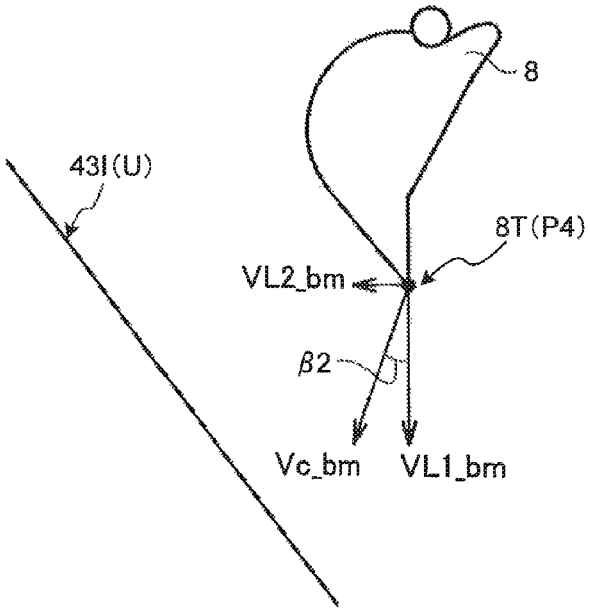
FIG. 8 is a diagram illustrating a method of calculating the vertical speed component and the horizontal speed component.
Figure 9:
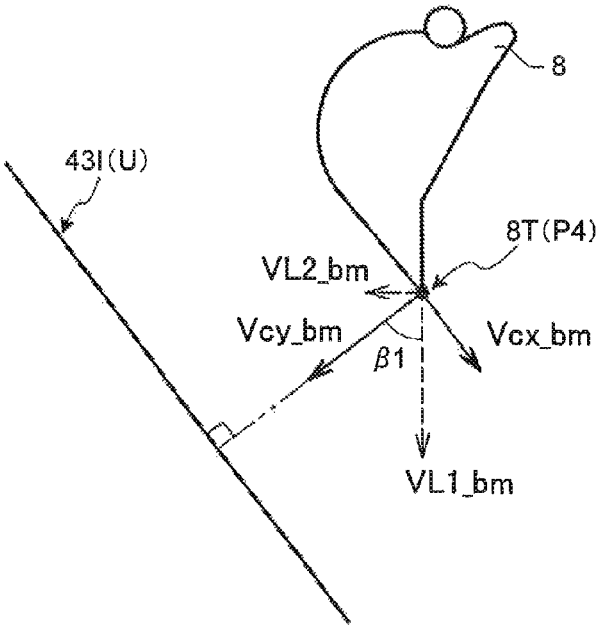
FIG. 9 is a diagram illustrating a method of calculating the vertical speed component and the horizontal speed component.
Figure 10:
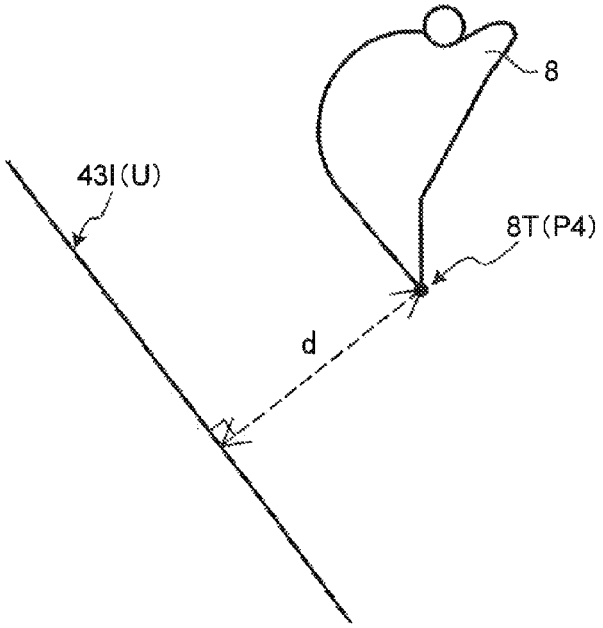
FIG. 10 is a schematic diagram illustrating a distance between a blade tip and a target excavation landform.
Figure 11:
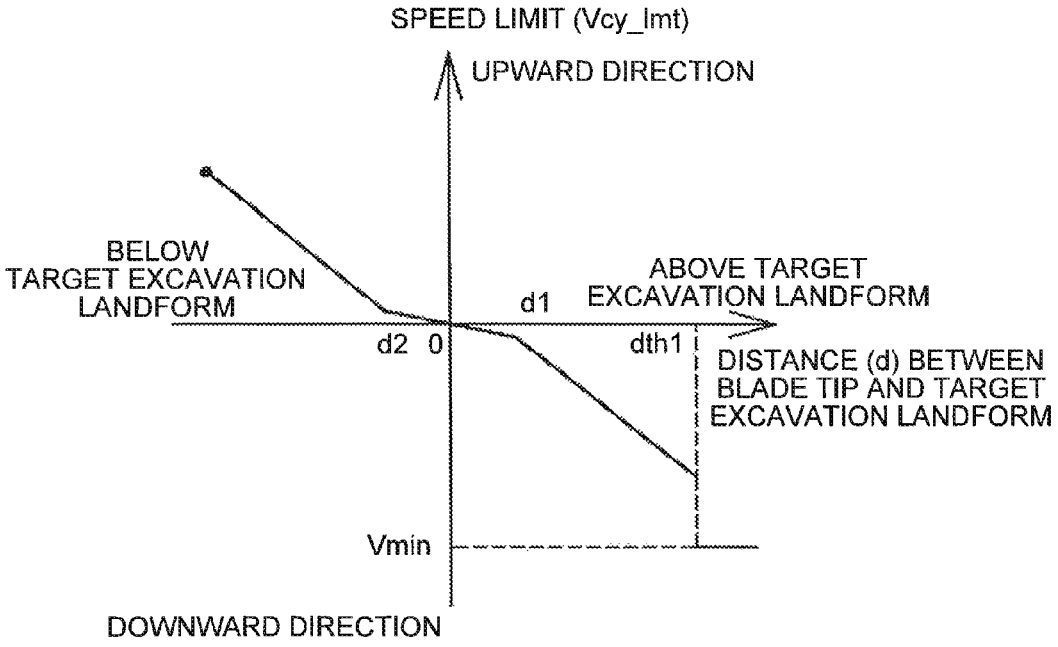
FIG. 11 is a graph illustrating an example of speed limit information.
Figure 12:
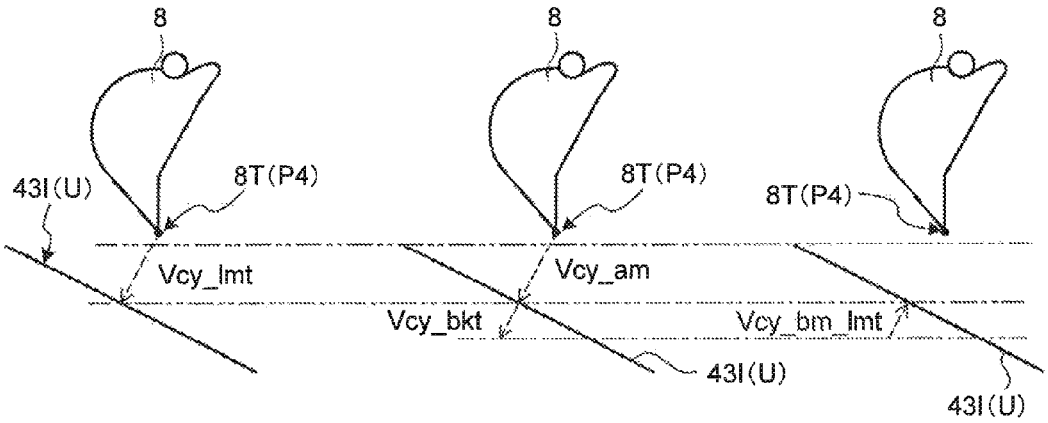
FIG. 12 is a schematic diagram illustrating a method of calculating a vertical speed component of a speed limit of a boom.
Figure 13:
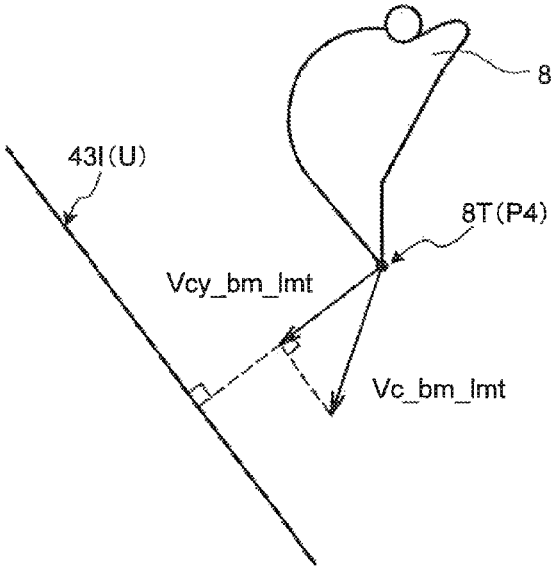
FIG. 13 is a schematic diagram illustrating a relationship between the vertical speed component of a speed limit of a boom and the speed limit of the boom.
Figure 14:
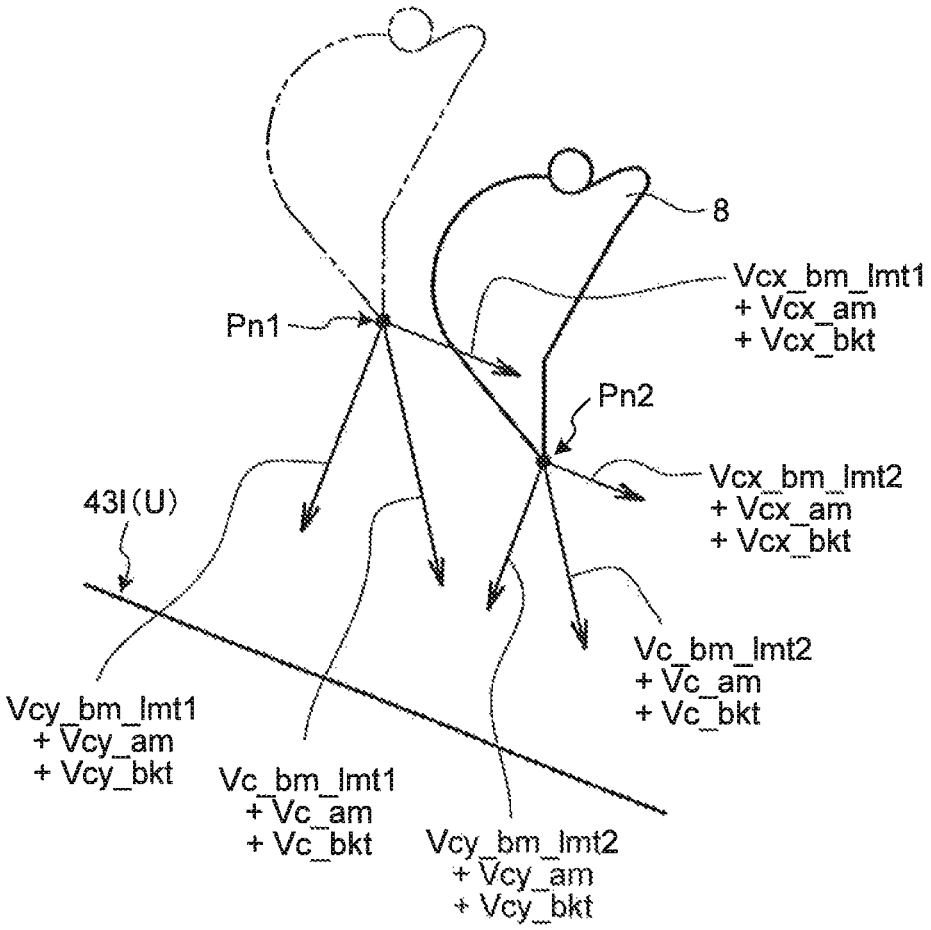
FIG. 14 is a diagram illustrating an example of change of the speed limit of the boom due to movement of the blade tip.

FIG. 5 is a block diagram illustrating the work machine control device 26 and the display control device 28. FIG. 6 is a diagram illustrating an example of the target excavation landform 43I displayed in the display unit 29. FIG. 7 is a schematic diagram illustrating a relationship among a target speed, a vertical speed component, and a horizontal speed component. FIG. 8 is a diagram illustrating a method of calculating the vertical speed component and the horizontal speed component. FIG. 9 is a diagram illustrating a method of calculating the vertical speed component and the horizontal speed component. FIG. 10 is a schematic diagram illustrating a distance between the blade tip and a target construction surface. FIG. 11 is a graph illustrating an example of speed limit information. FIG. 12 is a schematic diagram illustrating a method of calculating a vertical speed component of a speed limit of the boom. FIG. 13 is a schematic diagram illustrating a relationship between the vertical speed component of the speed limit of the boom and the speed limit of the boom. FIG. 14 is a diagram illustrating an example of change of the speed limit due to movement of the blade tip.

As illustrated in FIGS. 2 and 5, the display control device 28 generates the target excavation landform data U and outputs the data to the work machine control device 26. The excavation control is executed when the operator of the excavator 100 selects execution of the excavation control using the switch 29S illustrated in FIG. 2 (excavation control mode). It is defined such that the excavation control is in execution even if the work machine 2 is actually being operated for excavation or the work machine 2 is stopped in the state where the excavation control mode is activated. When the operator wishes to cancel the excavation control mode and to operate the work machine 2, the operator operates the switch 29S to cancel the excavation control mode. Further, when the operator has turned the state of an ignition key 103 OFF (key-off) to stop the engine 35, the excavation control mode is automatically canceled. If an update command PC transmitted from a management server 111 has already been received when the ignition key 103 is turned OFF, the update processing of the target construction information T is executed as described below.

As a method of transferring to the excavation control mode, there is a method of transferring to the excavation control mode (the excavation control mode is in execution) when a distance between the position of the blade tip 8T of the bucket 8 and a predetermined position of the target excavation landform data U (target excavation landform 43I) is within a predetermined distance. To cancel the excavation control mode, the excavation control mode may be canceled when the bucket 8 or the work machine 2 is moved and away from the object to be excavated, and the position of the blade tip 8T and the predetermined position of the target excavation landform data U (target excavation landform 43I) exceeds the predetermined distance.

In execution of the excavation control, the work machine control device 26 generates a boom command signal CBI necessary for the excavation control, and an arm command signal and a bucket command signal as needed using the boom operation amount MB, the arm operation amount MA, the bucket operation amount MT, the target excavation landform data U acquired from the display control device 28, and the work machine angles θ1, θ2, and θ3 acquired from the sensor control device 39, and drives the control valves 27 and the intervention valve 27C to control the work machine 2.

The display control device 28 will be described in detail. The display control device 28 includes a target construction information storage unit 28A, a bucket blade tip position data generation unit 28B, and a target excavation landform data generation unit 28C. The target construction information storage unit 28A is a part of the storage unit 28M of the display control device 28, and stores the target construction information T as the information indicating the target form in the work area GD. The target construction information T includes coordinate data and angle data required for generating the target excavation landform data U as the information indicating the target form of an object to be excavated. The target construction information T includes position information of the plurality of target construction surfaces 41.

The target construction information T necessary for the work machine control device 26 to control the work machine 2 or displaying the target excavation landform data Ua in the display unit 29 to execute the excavation control is downloaded from the management server 111 of a management center 110 to the target construction information storage unit 28A by wireless communication through the antenna 40A and the communication unit 40 illustrated in FIGS. 2 and 5, for example. Further, the target construction information T may be downloaded such that a personal computer or a mobile phone device that is a terminal device storing the target construction information T is connected to the display control device 28 by wireless communication, and the target construction information T is downloaded to the target construction information storage unit 28A, or the target construction information T is stored in a storage device such as a universal serial bus (USB) memory, which is not usually equipped with the excavator 100, and is portable by a manager, or the like, and the storage device is connected to the display control device 28 in a wired manner and the target construction information T may be transferred to the target construction information storage unit 28A. In this case, wired connection includes connection between the storage device and the display control device 28 with wire such as a communication cable, and direct connection of the storage device to a connection port provided in the display control device 28, and the like. As another example, the target construction information T may be downloaded such that a personal computer or a mobile phone device that is a terminal device storing the target construction information T is connected to the display control device 28 by wired communication, and the target construction information T is downloaded to the target construction information storage unit 28A. In downloading of the target construction information T by the wired communication with the storage device or the wired communication of the terminal device, an input/output device including an input/output port is used as the communication unit 40. That is, the above-described communication unit 40 can communicate with external devices, such as the management server 111, a personal computer, a mobile phone device, and a storage device.

The bucket blade tip position data generation unit 28B generates swing center position data XR that indicates a position of a swing center of the excavator 100, which passes through the swing axis z of the upper swing body 3 based on the reference position data P and the swing body azimuth data Q acquired from the global coordinate calculation unit 23. x-y coordinates of the swing center position data XR accord with x-y coordinates of the reference position PL of the local coordinate system.

The bucket blade tip position data generation unit 28B generates the bucket blade tip position data S that indicates a current position of the blade tip 8T of the bucket 8 based on the swing center position data XR, the work machine angles θ1, θ2, and θ3 of the work machine 2, and the work machine data L1, L2, and L3 and the position information of the reference position PL of the local coordinate system to the boom pin 13 obtained from the work machine storage unit 26M of the work machine control device 26. The work machine processing unit 26P also generates, even in the work machine control device 26, the bucket blade tip position data S that indicates a current position of the blade tip 8T of the bucket 8 based on the work machine angles θ1, θ2, and θ3, the work machine data L1, L2, and L3, and the position information of the reference position PL of the local coordinate system to the boom pin 13.

The bucket blade tip position data generation unit 28B acquires the reference position data P and the swing body azimuth data Q from the global coordinate calculation unit 23 with a predetermined frequency. Therefore, the bucket blade tip position data generation unit 28B can update the bucket blade tip position data S with a predetermined frequency. The bucket blade tip position data generation unit 28B outputs the updated bucket blade tip position data S to the target excavation landform data generation unit 28C.

The target excavation landform data generation unit 28C acquires the target construction information T stored in the target construction information storage unit 28A and the bucket blade tip position data S from the bucket blade tip position data generation unit 28B. The target excavation landform data generation unit 28C sets an intersection point of a perpendicular line that passes through a blade tip position P4 of the blade tip 8T at the current moment, and the target construction surface 41, in the local coordinate system, as an excavation object position 44. The excavation object position 44 is a point directly under the blade tip position P4 of the bucket 8. The target excavation landform data generation unit 28C acquires, as illustrated in FIG. 4, a line intersection 43 of a plane 42 of the work machine 2 defined in the front and back direction of the upper swing body 3 and passing through the excavation object position 44, and the target construction information T expressed by the plurality of target construction surfaces 41 as a candidate line of the target excavation landform 43I based on the target construction information T and the bucket blade tip position data S. The excavation object position 44 is one point on the candidate line. The plane 42 is a plane (operation plane) on which the work machine 2 is operated.

The operation plane of the work machine 2 is a plane parallel to the x-z plane of the excavator 100 as viewed from the z axis side of the local coordinate system of the excavator 100 in the case of the excavator 100 as illustrated in FIG. 1 in which the boom 6 and the arm 7 are not moved in the y axis direction. The operation plane of the work machine 2 is a plane perpendicular to the axis around which the arm 7 revolves, that is, an axis line of the arm pin 14 illustrated in FIG. 1, as viewed from the z axis side of the local coordinate system of the excavator 100 in a case of the excavator having the structure of the work machine 2, in which at least one of the boom 6 and the arm 7 is moved in the y axis direction. Hereinafter, the operation plane of the work machine 2 will be referred to as arm operation plane.

The target excavation landform data generation unit 28C determines one or a plurality of inflection points before and after the excavation object position 44 of the target construction information T, and lines before and after the inflection points as the target excavation landforms 43I that are to be objects to be excavated. In the example illustrated in FIG. 4, two inflection points Pv1 and Pv2, and lines before and after the two inflection points are determined as the target excavation landforms 43I. Then, the target excavation landform data generation unit 28C generates position information of one or a plurality of the inflection points before and after the excavation object position 44 and angle information of the lines before and after the inflection points as the target excavation landform data U that is the information indicating the target form of the object to be excavated. In the present embodiment, the target excavation landform 43I is defined by a line. However, the target excavation landform 43I may be defined by a plane based on the width of the bucket 8, and the like, for example. The target excavation landform data U generated in this way includes information of a part of the plurality of target construction surfaces 41. The target excavation landform data generation unit 28C outputs the generated target excavation landform data U to the work machine control device 26. In the present embodiment, the display control device 28 and the work machine control device 26 directly exchange signals. However, the display control device 28 and the work machine control device 26 may exchange signals through an in-vehicle signal line like a controller area network (CAN), for example.

In the present embodiment, the target excavation landform data U is information of a portion where the plane 42 as the operation plane in which the work machine 2 is operated and one target construction surface (first target construction surface) 41 that indicates the target form. The plane 42 is the x-y plane in the local coordinate system (x, y, z) illustrated in FIGS. 3A and 3B. The target excavation landform data U obtained by cutting the plurality of target construction surfaces 41 with the plane 42 is appropriately referred to as front-back direction target excavation landform data U.

The display control device 28 displays the target excavation landform 43I in the display unit 29 based on the front-back direction target excavation landform data U as first target excavation landform information. As display information, the display target excavation landform data Ua is used. An image that indicates a positional relationship between the target excavation landform 43I and the blade tip 8T set as the objects to be excavated of the bucket 8, as illustrated in FIG. 2, is displayed in the display unit 29 based on the display target excavation landform data Ua. The display control device 28 displays the target excavation landform (display target excavation landform) 43I in the display unit 29 based on the display target excavation landform data Ua. The front-back direction target excavation landform data U output to the work machine control device 26 is used for the excavation control. The target excavation landform data U used for the excavation control is appropriately referred to as work target excavation landform data U.

The target excavation landform data generation unit 28C acquires, as described above, the bucket blade tip position data S from the bucket blade tip position data generation unit 28B with a predetermined frequency. Therefore, the target excavation landform data generation unit 28C can update the front-back direction target excavation landform data U with a predetermined frequency, and can output the updated data to the work machine control device 26. Next, the work machine control device 26 will be described in detail.

The work machine control device 26 includes the work machine storage unit 26M and the work machine processing unit 26P described above. A configuration of the work machine processing unit 26P includes, as illustrated in detail in FIG. 5, a target speed determination unit 52, a distance acquisition unit 53, a speed limit determination unit 54, and a work machine control unit 57. The work machine control device 26 executes the excavation control using the target excavation landform 43I based on the above-described front-back direction target excavation landform data U. As described above, in the present embodiment, there are the target excavation landform 43I used for display and the target excavation landform 43I used for the excavation control. The former is referred to as display target excavation landform, and the latter is referred to as excavation control target excavation landform.

As described above, in the present embodiment, functions of the target speed determination unit 52, the distance acquisition unit 53, the speed limit determination unit 54, and the work machine control unit 57 are realized by the work machine processing unit 26P illustrated in FIG. 2. Next, the excavation control by the work machine control device 26 will be described.

The target speed determination unit 52 determines a boom target speed Vc_bm, an arm target speed Vc_am, and a bucket target speed Vc_bkt. The boom target speed Vc_bm is a speed of the blade tip 8T of when only the boom cylinder 10 is driven. The arm target speed Vc_am is a speed of the blade tip 8T of when only the arm cylinder 11 is driven. The bucket target speed Vc_bkt is a speed of the blade tip 8T of when only the bucket cylinder 12 is driven. The boom target speed Vc_bm is calculated according to the boom operation amount MB. The arm target speed Vc_am is calculated according to the arm operation amount MA. The bucket target speed Vc_bkt is calculated according to the bucket operation amount MT.

The work machine storage unit 26M stores target speed information that defines a relationship between the boom operation amount MB and the boom target speed Vc_bm. The target speed determination unit 52 determines the boom target speed Vc_bm corresponding to the boom operation amount MB by reference to the target speed information. The target speed information is a graph in which magnitude of the boom target speed Vc_bm corresponding to the boom operation amount MB is described, for example. The target speed information may be a form of a table, a numerical expression, or the like. The target speed information includes information that defines a relationship between the arm operation amount MA and the arm target speed Vc_am. The target speed information includes information that defines a relationship between the bucket operation amount MT and the bucket target speed Vc_bkt. The target speed determination unit 52 determines the arm target speed Vc_am corresponding to the arm operation amount MA by reference to the target speed information. The target speed determination unit 52 determines the bucket target speed Vc_bkt corresponding to the bucket operation amount MT by reference to the target speed information. The target speed determination unit 52 converts, as illustrated in FIG. 7, the boom target speed Vc_bm into a speed component (hereinafter, appropriately referred to as vertical speed component) Vcy_bm in a direction perpendicular to the target excavation landform 43I (target excavation landform data U) and a speed component (hereinafter, appropriately referred to as horizontal speed component) Vcx_bm in a direction parallel to the target excavation landform 43I (target excavation landform data U).

For example, first, the target speed determination unit 52 acquires the inclination angle θ5 from the sensor control device 39, and obtains an inclination in a direction perpendicular to the target excavation landform 43I with respect to a vertical axis of the global coordinate system. Then, the target speed determination unit 52 obtains an angle β2 (see FIG. 8) that expresses an inclination of the vertical axis of the local coordinate system and the direction perpendicular to the target excavation landform 43I from these inclinations.

Next, the target speed determination unit 52 converts, as illustrated in FIG. 8, the boom target speed Vc_bm into a speed component VL1_bm in the vertical axis direction of the local coordinate system and a speed component VL2_bm in the horizontal axis direction from the angle β2 made by the vertical axis of the local coordinate system and the direction of the boom target speed Vc_bm by a trigonometric function. Then, as illustrated in FIG. 9, the target speed determination unit 52 converts the speed component VL1_bm in the vertical axis direction of the local coordinate system and the speed component VL2_bm in the horizontal axis direction into the vertical speed component Vcy_bm with respect to the target excavation landform 43I and a horizontal speed component Vcx_bm from an inclination β1 made by the vertical axis of the local coordinate system and the direction perpendicular to the target excavation landform 43I by a trigonometric function. Similarly, the target speed determination unit 52 converts the arm target speed Vc_am into a vertical speed component Vcy_am in the vertical axis direction of the local coordinate system and a horizontal speed component Vcx_am. The target speed determination unit 52 converts the bucket target speed Vc_bkt into a vertical speed component Vcy_bkt in the vertical axis direction of the local coordinate system and a horizontal speed component Vcx_bkt.

The distance acquisition unit 53 acquires, as illustrated in FIG. 10, a distance d between the blade tip 8T of the bucket 8 and the target excavation landform 43I. To be specific, the distance acquisition unit 53 calculates a shortest distance d between the blade tip 8T of the bucket 8 and the target excavation landform 43I from the obtained position information of the blade tip 8T and target excavation landform data U that indicates the position of the target excavation landform 43I. In the present embodiment, the excavation control is executed based on the shortest distance d between the blade tip 8T of the bucket 8 and the target excavation landform 43I.

The speed limit determination unit 54 calculates a speed limit Vcy_lmt of the work machine 2 illustrated in FIG. 1 as a whole based on the distance d between the blade tip 8T of the bucket 8 and the target excavation landform 43I. The speed limit Vcy_lmt of the work machine 2 as a whole is an allowable moving speed of the blade tip 8T in a direction into which the blade tip 8T of the bucket 8 comes close to the target excavation landform 43I. The work machine storage unit 26M illustrated in FIG. 2 stores speed limit information that defines a relationship between the distance d and the speed limit Vcy_lmt.

FIG. 11 illustrates an example of the speed limit information. The horizontal axis in FIG. 11 represents the distance d, and the vertical axis represents the speed limit Vcy_lmt. In the present embodiment, the distance d is a positive value when the blade tip 8T is positioned outside the target excavation landform 43I, that is, positioned at the work machine 2 side of the excavator 100, and the distance d is a negative value when the blade tip 8T is positioned inside the target excavation landform 43I, that is, positioned at an inner side of the object to be excavated than the target excavation landform 43I. For example, it can also be said that, as illustrated in FIG. 10, the distance d is a positive value when the blade tip 8T is positioned above the target excavation landform 43I, and the distance d is a negative value when the blade tip 8T is positioned below the target excavation landform 43I. Further, it can also be said that the distance d is a positive value when the blade tip 8T is at a position where the blade tip 8T does not erode the target excavation landform 43I, and the distance d is a negative value when the blade tip 8T is at a position where the blade tip 8T erodes the target excavation landform 43I. When the blade tip 8T is positioned on the target excavation landform 43I, that is, when the blade tip 8T is in contact with the target excavation landform 43I, the distance d is 0.

In the present embodiment, a speed of the blade tip 8T is a positive value when the blade tip 8T goes from an inside to an outside of the target excavation landform 43I, and a speed of the blade tip 8T is a negative value when the blade tip 8T goes from an outside to an inside of the target excavation landform 43I. That is, the speed of the blade tip 8T is a positive value when the blade tip 8T goes upward of the target excavation landform 43I, and the speed of the blade tip 8T is a negative value when the blade tip 8T goes downward.

In the speed limit information, an inclination of the speed limit Vcy_lmt of when the distance d is between d1 and d2 is smaller than an inclination of when the distance d is from d1 to d2, both inclusive. d1 is larger than 0. d2 is smaller than 0. In an operation near the target excavation landform 43I, to set the speed limit in more detail, the inclination of when the distance d is between d1 and d2 is made smaller than the inclination of when the distance d is d1 or more and d2 or less. When the distance d is d1 or more, the speed limit Vcy_lmt is a negative value, and the speed limit Vcy_lmt becomes smaller as the distance d becomes larger. That is, when the distance d is d1 or more, the speed going downward of the target excavation landform 43I becomes larger and an absolute value of the speed limit Vcy_lmt becomes larger, as the blade tip 8T is more distant from the target excavation landform 43I above the target excavation landform 43I. When the distance d is 0 or less, the speed limit Vcy_lmt is a positive value, and the speed limit Vcy_lmt becomes larger as the distance d becomes smaller. That is, when the distance d of the blade tip 8T of the bucket 8 being away from the target excavation landform 43I is 0 or less, the speed going upward of the target excavation landform 43I becomes larger, and the absolute value of the speed limit Vcy_lmt becomes larger, as the blade tip 8T is more distant from the target excavation landform 43I below the target excavation landform 43I.

When the distance d is a first predetermined value dth1 or more, the speed limit Vcy_lmt is Vmin. The first predetermined value dth1 is a positive value, and larger than d1. Vmin is smaller than the minimum value of the target speed. That is, when the distance d is the first predetermined value dth1 or more, limitation of the operation of the work machine 2 is not performed. Therefore, when the blade tip 8T is substantially distant from the target excavation landform 43I above the target excavation landform 43I, limitation of the operation of the work machine 2, that is, the excavation control is not performed. When the distance d is smaller than the first predetermined value dth1, the limitation of the operation of the work machine 2 is performed. In more detail, when the distance d is smaller than the first predetermined value dth1, limitation of the operation of the boom 6 is performed, as described below.

The speed limit determination unit 54 calculates a vertical speed component (hereinafter, appropriately referred to as limit vertical speed component of the boom 6) Vcy_bm_lmt of the speed limit of the boom 6 from the speed limit Vcy_lmt of the work machine 2 as a whole, the arm target speed Vc_am, and the bucket target speed Vc_bkt. The speed limit determination unit 54 calculates, as illustrated in FIG. 12, a limit vertical speed component Vcy_bm_lmt of the boom 6 by subtracting the vertical speed component Vcy_am of the arm target speed and the vertical speed component Vcy_bkt of the bucket target speed from the speed limit Vcy_lmt of the work machine 2 as a whole.

The speed limit determination unit 54 converts, as illustrated in FIG. 13, the limit vertical speed component Vcy_bm_lmt of the boom 6 into a speed limit (boom speed limit) Vc_bm_lmt of the boom 6. The speed limit determination unit 54 obtains a relationship between the direction perpendicular to the target excavation landform 43I and a direction of a boom speed limit Vc_bm_lmt from the inclination angle θ1 of the boom 6, the inclination angle θ2 of the arm 7, the inclination angle θ3 of the bucket 8, the reference position data of the GNSS antennas 21 and 22, the target excavation landform data U, and the like, and converts the limit vertical speed component Vcy_bm_lmt of the boom 6 into the boom speed limit Vc_bm_lmt. Calculation of this case is performed by a reverse procedure to the calculation of obtaining the vertical speed component Vcy_bm in the direction perpendicular to the target excavation landform 43I from the boom target speed Vc_bm.

The shuttle valve 51 illustrated in FIG. 2 selects a larger pilot hydraulic pressure of the pilot hydraulic pressure generated by the intervention valve 27C based on the operation of the boom 6 and the pilot hydraulic pressure generated based on a boom intervention command CBI, and supplies the selected pilot hydraulic pressure to the direction control valve 64. When the pilot hydraulic pressure based on the boom intervention command CBI is larger than the pilot hydraulic pressure generated based on the operation of the boom 6, the direction control valve 64 corresponding to the boom cylinder 10 is operated by the pilot hydraulic pressure based on the boom intervention command CBI. As a result, driving of the boom 6 based on the boom speed limit Vc_bm_lmt is realized.

The work machine control unit 57 controls the work machine 2. The work machine control unit 57 controls the boom cylinder 10, the arm cylinder 11, and the bucket cylinder 12 by outputting an arm command signal CA, a boom command signal CB, a boom intervention command CBI, and a bucket command signal CT to the control valves 27 and the intervention valve 27C illustrated in FIG. 2. The arm command signal CA, the boom command signal CB, the boom intervention command CBI, and the bucket command signal CT include current values according to a boom command speed, an arm command speed, and a bucket command speed, respectively.

The pilot hydraulic pressure generated based on the raising operation of the boom 6 is larger than the pilot hydraulic pressure based on the boom intervention command CBI, the shuttle valve 51 selects the pilot hydraulic pressure based on a lever operation. The direction control valve 64 corresponding to the boom cylinder 10 is operated by the pilot hydraulic pressure selected by the shuttle valve 51 based on the operation of the boom 6. That is, the boom 6 is driven based on the boom target speed Vc_bm, and thus is not driven based on the boom speed limit Vc_bm_lmt.

When the pilot hydraulic pressure generated based on the operation of the boom 6 is larger than the pilot hydraulic pressure based on the boom intervention command CBI, the work machine control unit 57 selects the boom target speed Vc_bm, the arm target speed Vc_am, and the bucket target speed Vc_bkt as the boom command speed, the arm command speed, and the bucket command speed, respectively. The work machine control unit 57 determines speeds (cylinder speeds) of the boom cylinder 10, the arm cylinder 11, and the bucket cylinder 12 according to the boom target speed Vc_bm, the arm target speed Vc_am, and the bucket target speed Vc_bkt. Then, the work machine control unit 57 controls the control valves 27 based on the determined cylinder speeds thereby to operate the boom cylinder 10, the arm cylinder 11, and the bucket cylinder 12.

As described above, at a normal operation, the work machine control unit 57 operates the boom cylinder 10, the arm cylinder 11, and the bucket cylinder 12 according to the boom operation amount MB, the arm operation amount MA, and the bucket operation amount MT. Therefore, the boom cylinder 10 is operated at the boom target speed Vc_bm, the arm cylinder 11 is operated at the arm target speed Vc_am, and the bucket cylinder 12 is operated at the bucket target speed Vc_bkt.

Meanwhile, when the pilot hydraulic pressure based on the boom intervention command CBI is larger than the pilot hydraulic pressure generated based on the operation of the boom 6, the shuttle valve 51 selects the pilot hydraulic pressure output from the intervention valve 27C based on an intervention command. As a result, the boom 6 is operated at the boom speed limit Vc_bm_lmt, and the arm 7 is operated at the arm target speed Vc_am. Further, the bucket 8 is operated at the bucket target speed Vc_bkt.

As described with reference to FIG. 12, the limit vertical speed component Vcy_bm_lmt of the boom 6 is calculated by subtracting the vertical speed component Vcy_am of the arm target speed and the vertical speed component Vcy_bkt of the bucket target speed from the speed limit Vcy_lmt of the work machine 2 as a whole. Therefore, when the speed limit Vcy_lmt of the work machine 2 as a whole is smaller than a sum of the vertical speed component Vcy_am of the arm target speed and the vertical speed component Vcy_bkt of the bucket target speed, the limit vertical speed component Vcy_bm_lmt of the boom 6 becomes a negative value with which the boom 6 is raised.

Therefore, the boom speed limit Vc_bm_lmt becomes a negative value. In this case, the work machine control unit 57 lowers the boom 6, and decreases the speed than the boom target speed Vc_bm. Therefore, the bucket 8 can be suppressed from eroding the target excavation landform 43I while the uncomfortable feeling of the operator is suppressed small.

When the speed limit Vcy_lmt of the work machine 2 as a whole is larger than a sum of the vertical speed component Vcy_am of the arm target speed and the vertical speed component Vcy_bkt of the bucket target speed, the limit vertical speed component Vcy_bm_lmt of the boom 6 is a positive value. Therefore, the boom speed limit Vc_bm_lmt becomes a positive value. In this case, even if the operation device 25 is operated in a direction lowering the boom 6, the boom 6 is raised based on the command signal from the intervention valve 27C illustrated in FIG. 2. Therefore, expansion of erosion of the target excavation landform 43I can be promptly suppressed.

When the blade tip 8T is positioned above the target excavation landform 43I, an absolute value of the limit vertical speed component Vcy_bm_lmt of the boom 6 becomes smaller, and an absolute value of a speed component (hereinafter, appropriately referred to as limit horizontal speed component) Vcx_bm_lmt of the speed limit of the boom 6 in a direction parallel to the target excavation landform 43I becomes smaller as the blade tip 8T is closer to the target excavation landform 43I. Therefore, when the blade tip 8T is positioned above the target excavation landform 43I, both of the speed of the boom 6 in the direction perpendicular to the target excavation landform 43I, and the speed of the boom 6 in the direction parallel to the target excavation landform 43I are decreased as the blade tip 8T is closer to the target excavation landform 43I. The left operation lever 25L and the right operation lever 25R are simultaneously operated by the operator of the excavator 100, so that the boom 6, the arm 7, and the bucket 8 are simultaneously operated. The above-described control will be described as follows assuming that the target speeds Vc_bm, Vc_am, and Vc_bkt of the boom 6, the arm 7, and the bucket 8 are input at this time.

FIG. 14 illustrates an example of change of the speed limit of boom 6 of when the distance d between the target excavation landform 43I and the blade tip 8T of the bucket 8 is smaller than the first predetermined value dth1, and the blade tip 8T of the bucket 8 is moved from a position Pn1 to a position Pn2. A distance between the blade tip 8T and the target excavation landform 43I at the position Pn2 is smaller than a distance between the blade tip 8T and the target excavation landform 43I at the position Pn1. Therefore, a limit vertical speed component Vcy_bm_lmt2 of the boom 6 at the position Pn2 is smaller than a limit vertical speed component Vcy_bm_lmt1 of the boom 6 at the position Pn1. Therefore, a boom speed limit Vc_bm_lmt2 at the position Pn2 becomes smaller than a boom speed limit Vc_bm_lmt1 at the position Pn1. Further, a limit horizontal speed component Vcx_bm_lmt2 of the boom 6 at the position Pn2 becomes smaller than a limit horizontal speed component Vcx_bm_lmt1 of the boom 6 at the position Pn1. Note that, at this time, limitation is not performed with respect to the arm target speed Vc_am and the bucket target speed Vc_bkt. Therefore, limitation is not performed with respect to the vertical speed component Vcy_am and the horizontal speed component Vcx_am of the arm target speed, and the vertical speed component Vcy_bkt and the horizontal speed component Vcx_bkt of the bucket target speed.

As described above, by not performing of the limitation to the arm 7, change of the arm operation amount MA corresponding to excavation intension of the operator is reflected as the speed change of the blade tip 8T of the bucket 8. Therefore, the present embodiment can suppress the uncomfortable feeling of the operator in an operation at the time of excavation while suppressing expansion of erosion of the target excavation landform 43I.

The blade tip position P4 of the blade tip 8T may be measured not only by the GNSS but also by another measurement means. Therefore, the distance d between the blade tip 8T and the target excavation landform 43I may be measured not only by the GNSS but also by other measurement means. An absolute value of the bucket speed limit is smaller than an absolute value of the bucket target speed. The bucket speed limit may be calculated by a technique similar to the above-described arm speed limit. Note that limitation of the bucket 8 may be performed together with the limitation of the arm 7.

The excavation control of controlling the operation speed of the work machine 2 so that the work machine 2 of the excavator 100 does not erode an object to be excavated has been described above. The excavation control may be control of causing the boom 6 of the work machine 2 to perform a raising operation when it is detected that the bucket 8 is moved to a position where the bucket 8 is more likely to erode the object to be excavated based on the position of the blade tip 8T of the bucket 8 of the work machine 2 and the position information of the target construction information T as the object to be excavated. Next, control of when the target construction information T is transmitted from the management server 111 of the management center 110 illustrated in FIG. 5 to the excavator 100, and the communication unit 40 has received the transmitted target construction information T when the excavator 100 is executing the excavation control.

(A Case where the Communication Unit 40 has Received the Target Construction Information T During the Excavation Control)

Figure 15:
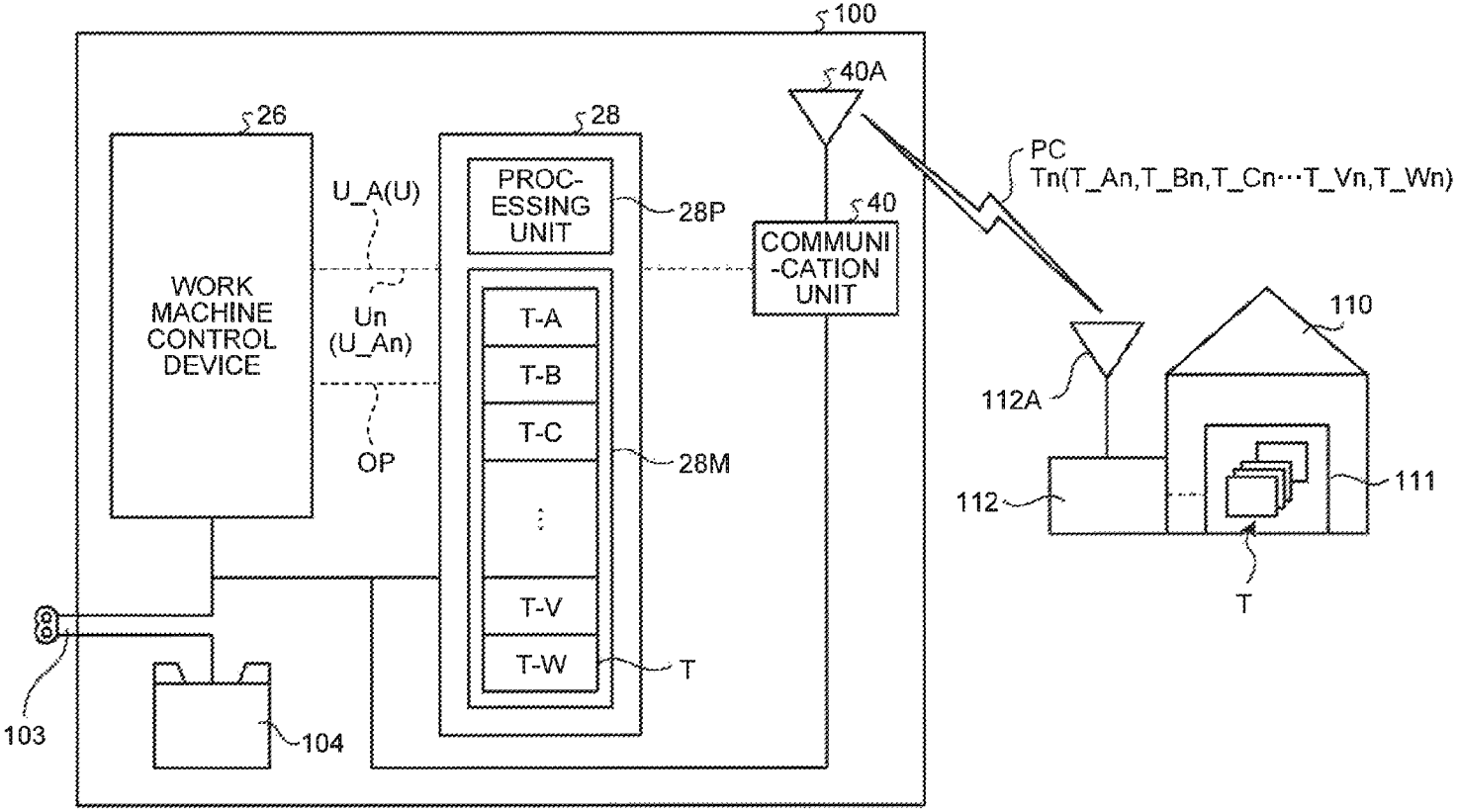
FIG. 15 is a diagram illustrating an excavator and a management center.

FIG. 15 is a diagram illustrating the excavator 100 and the management center 110. In the present embodiment, the target construction information T is generated at the management center 110 according to an object to be constructed of the excavator 100, and stored in the management server 111. As described above, the design surface information TI includes the target construction information T, and the target construction information T includes the construction information that indicates the target form of the object to be excavated. The target construction information T stored in the management server 111 is transmitted to the excavator 100 through a communication device 112 and an antenna 112A of the management center 110.

Power supply is performed from a capacitor 104 to devices including the communication unit 40 at a timing when the ignition key 103 of the excavator 100 is turned ON. When the communication unit 40 having a wireless communication function is used, after the power supply is performed from the capacitor 104 to the devices including the communication unit 40, the excavator 100 performs wireless communication with the management server 111 through the antenna 40A, and receives the target construction information T from the management server 111. As long as the ignition key 103 is ON regardless of the timing at which the ignition key 103 is turned ON, the power supply to the devices including the communication unit 40 is performed, and a state in which the target construction information T can be received from an external device such as the management server 111 or a terminal device is continued.

The target construction information T transmitted from the management server 111 is received by the communication unit 40 through the antenna 40A of the excavator 100. The storage unit 28M of the display control device 28 stores the target construction information T received by the communication unit 40. In the example of FIG. 15, the storage unit 28M stores a plurality of pieces of target construction information T_A, T_B, T_C, . . . T_V, T_W. The reference signs A, B, C, . . . V, W attached to the target construction information T are file names of design surface information.

When the excavator 100 executes the excavation operation, the operator operates the switch 29S illustrated in FIG. 2 to transmit a command of executing the excavation control to the display control device 28. At this time, the operator selects a range of the target construction surface 41 that is to be an object of the excavation control with an input unit (not illustrated) of the display control device 28. A processing unit 28P of the display control device 28 reads out the target construction information T corresponding to the selected range from the storage unit 28M, and generates and transmits the target excavation landform data U to the work machine control device 26. In this example, the target construction information corresponding to the selected range is target construction information T_A of a file name A, and target excavation landform data U_A is generated from the target construction information T_A. The work machine control device 26 executes the excavation control using the target excavation landform data U_A.

New target construction information Tn transmitted from the management server 111 includes a command (update command) PC of updating the target construction information T in the storage unit 28M of the display control device 28 to the new target construction information Tn. The new target construction information Tn and the update command PC are transmitted from the management server 111, and when the communication unit 40 of the excavator 100 receives these information and command, the processing unit 28P of the display control device 28 stores the new target construction information Tn received by the communication unit 40 in the storage unit 28M. Then, the target construction information T currently stored in the storage unit 28M is rewritten with the new target construction information Tn received by the communication unit 40, and updated. As described above, in the present embodiment, the processing unit 28P determines whether updating the target construction information T stored in the storage unit 28M to the new target construction information Tn. The processing unit 28P generates target excavation landform data U_n based on the new target construction information T, and the work machine control device 26 executes the excavation control based on the target excavation landform data U_n. When the target construction information T_A of the file name A is rewritten with the new target construction information T_An, the processing unit 28P generates target excavation landform data U_An based on the new target construction information T_An, and the work machine control device 26 executes the excavation control based on the target excavation landform data U_An.

Assume that, at a timing when the new target construction information Tn is transmitted from the management server 111 to the excavator 100, the work machine control device 26 is executing the excavation control using the target excavation landform data U_A generated from the target construction information T_A. When the communication unit 40 has received the new target construction information Tn including the new target construction information T_An of the file name A, the storage unit 28M rewrites the current target construction information T_A with the new target construction information T_An. At this timing, the work machine control device 26 is executing the excavation control, and thus the work machine control device 26 executes the excavation control based on the target excavation landform data U_An generated based on the new target construction information T_An.

However, when the content of the target construction information T_A before the communication unit 40 receives the new target construction information T_An and the content of the new target construction information T_An are different, and if the target construction information T_A is updated to the new target construction information T_An during execution of the excavation control, the operator of the excavator does not recognize that the target construction information T_A has been updated to the target construction information T_An, and operates the work machine 2 while recognizing that the excavation control is being executed to the work machine 2 with respect to the target construction information T_A of before update, and may feel uncomfortable. As a result, the target form may be constructed into a form that is not intended by the operator of the excavator 100. To avoid this situation, the control system 200 does not use design surface information other than the target construction information T_A that is being used for the running excavation control until the running excavation control is completed when the work machine control device 26 is executing the excavation control. Therefore, the control system 200 continues the excavation control without using the new target construction information T_An in a state of waiting for update to the new target construction information T_An and the excavation control is being executed by the work machine control device 26.

Therefore, in the present embodiment, when the work machine control device 26 is executing the excavation control, the work machine control device 26 continues the excavation control using only the target excavation landform data U_A generated from the target construction information T_A that is being used for the running excavation control. In doing so, the control system 200 does not update, in performing computer-aided construction using the excavator 100, the construction information that is not intended by the operator of the excavator 100. Therefore, the operator can operate the work machine 2 without feeling uncomfortable.

For example, when the communication unit 40 has received the new target construction information T_An of the file name A, the storage unit 28M does not update the target construction information T_A being used for the running excavation control to the new target construction information T_An received by the communication unit 40. The storage unit 28M updates target construction information T_B, T_C, . . . T_V, T_W of file names B, C, D, . . . V, W, which are not used for the running excavation control, to new target construction information T_Bn, T_Cn, . . . T_Vn, T_Wn. That is, the processing unit 28P of the display control device 28 does not update the design surface information to be used for the excavation control to the new design surface information received by the communication unit 40 when the file name (A in this example) of the design surface information being used for the excavation control by the work machine control device 26 and the file name (A in this example) of the new design surface information received by the communication unit 40 are the same. The processing unit 28P may generate, when having received new design surface information, reception information that indicates the new design surface information TI has been received, and may display the reception information in the display unit 29. As the reception information, at least one of a predetermined icon, a caution mark, and character information can be used. For example, when the processing unit 28P has determined that the file name (A in this example) of the using design surface information and the file name (A in this example) of the new design surface information received by the communication unit 40 are the same, the processing unit 28P may generate reception information that means these pieces of information are the same, and may display the reception information in the display unit 29. Further, the processing unit 28P may display the reception information in the display unit 29 when having received the new design surface information while the excavation control is not being executed. The processing unit 28P then updates the design surface information to be used for the excavation control to new design surface information received by the communication unit 40 when the file name (A in this example) of the design surface information being used for the excavation control by the work machine control device 26 and the file name (B, C, . . . , V, W) of the new design surface information received by the communication unit 40 are not the same. If appropriateness of update of the target construction information T is determined according to the file name of the target construction information T, the appropriateness of update can be easily and reliably determined.

In doing so, the work machine control device 26 can continue the excavation control using only the target excavation landform data U_A generated from the target construction information T_A that is being used for the running excavation control. Further, the target construction information T_B, T_C, or the like that is not being used for the excavation control is updated to the new target construction information T_Bn, T_Cn, or the like. In this case, the storage unit 28M temporarily stores the new target construction information T_An in a buffer, and when the excavation control is completed, or when the engine 35 is stopped and the excavator 100 is suspended, the storage unit 28M updates the target construction information T_A that has been used for the excavation control to the new target construction information T_An received by the communication unit 40.

(Control Example)

Figure 16:
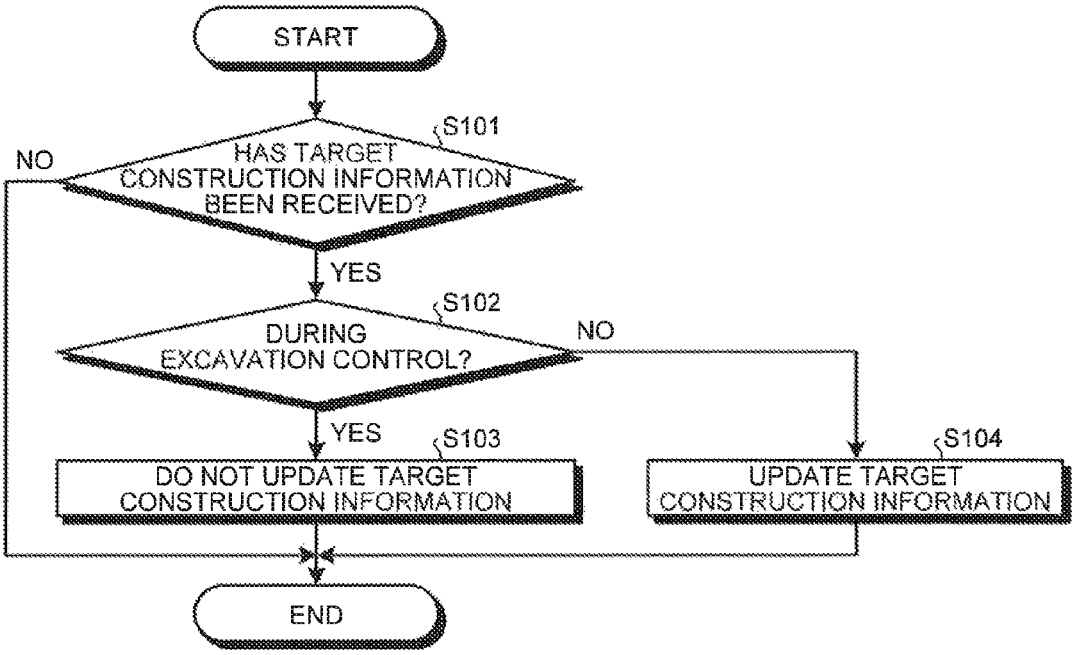
FIG. 16 is a flowchart illustrating an example of control (control of updating construction information) during excavation control.

FIG. 16 is a flowchart illustrating a control example (update control of the construction information) during the excavation control. In step S101, the processing unit 28P of the display control device 28 determines whether the communication unit 40 has received the new target construction information Tn from the management server 111. When the communication unit 40 has received the new target construction information Tn (Yes in step S101), the processing unit 28P proceeds with the processing to step S102. When the communication unit 40 has not received the new target construction information Tn (No in step S101), the processing is terminated.

In step S102, the processing unit 28P determines whether the work machine control device 26 is executing the excavation control. For example, during the excavation control, the work machine control device 26 transmits an execution signal OP of the excavation control to the display control device 28. The processing unit 28P of the display control device 28 determines that the excavation control is being executed while receiving the execution signal OP (Yes in step S102). In this case, the processing proceeds to step S103, and the processing unit 28P of the display control device 28 does not update the target construction information T currently being used for the excavation control to the new target construction information Tn received by the communication unit 40 in step S101.

When the excavation control is not being executed (No in step S102), for example, when the processing unit 28P of the display control device 28 does not receive the execution signal OP, the processing unit 28P proceeds the processing to step S104. In step S104, the processing unit 28P updates the target construction information T currently held by the storage unit 28M to the new target construction information Tn received by the communication unit 40 in step S101.

In the present embodiment, the processing unit 28P of the display control device 28 determines whether updating the target construction information T used for the excavation control by the work machine control device 26 to the new target construction information Tn received by the communication unit 40 based on the file name of the target construction information T. Other than the above, when the position information of the target construction information T being used for the excavation control and the position information of the new target construction information Tn received by the communication unit 40 are the same, the processing unit 28P of the display control device 28 may not update the target construction information T to be used for the excavation control to the new target construction information Tn received by the communication unit 40. In this case, for example, when the target construction surface 41 of the target construction information T (see FIG. 4) being used for the excavation control and the target construction surface 41 of the new target construction information Tn can be considered the same plane, the position information of both surfaces can be considered the same.

In the present embodiment, the processing unit 28P of the display control device 28 may update the target construction information T to be used for the excavation control to the new target construction information Tn received by the communication unit 40 when the excavator 100 is key-off, that is, when the ignition key 103 is OFF, other than the case where the excavation control is not being executed. For example, when the communication unit 40 has received the new target construction information Tn when the ignition key 103 is ON, the processing unit 28P of the display control device 28 temporarily stores the new target construction information Tn in the buffer of the storage unit 28M. Then, at a timing when the ignition key 103 is turned OFF, the processing unit 28P updates the target construction information T currently stored in the storage unit 28M to the new target construction information Tn stored in the buffer. In doing so, when the ignition key 103 is ON, the target construction information T to be used for the excavation control is not updated, and thus the update of the target construction information that is not intended by the operator of the excavator 100 is not performed, and the operator can recognize the target construction information has been updated and can operate the work machine 2.

In this case, the processing unit 28P of the display control device 28 receives the update command PC transmitted together with the new target construction information Tn from the management server 111, and holds the update command PC until the ignition key 103 is turned OFF. By holding of the update command PC, the processing unit 28P of the display control device 28 puts off update of the target construction information T. When the update command PC and OFF of the ignition key 103 are established, the processing unit 28P of the display control device 28 maintains the power supply from the capacitor 104 until the processing of update is completed using a self-holding circuit (not illustrated). In this state, the processing unit 28P of the display control device 28 updates the target construction information T in the storage unit 28M to the new target construction information Tn stored in the buffer. When the update is completed, the processing unit 28P deletes the update command PC, and the self-holding circuit stops the power supply from the capacitor 104.

When the ignition key 103 is turned OFF and the engine 35 is stopped, and the excavator 100 is suspended, the devices such as the communication unit 40 may be started at a predetermined time, and may be able to receive the update command PC together with the new target construction information Tn from the management server 111 through the antenna 40A. In this case, for example, a timer program for starting the display control device 28 itself and the communication unit 40 at a predetermined time is incorporated in the display control device 28. The timer program executes processing of supplying power to the devices such as the communication unit 40 from the capacitor 104 when the predetermined time during the nighttime, for example, has come. Further, the display control device 28 performs update control of the target construction information. That is, the storage unit 28M updates the stored target construction information T to the new received target construction information Tn, and after the update is completed, the timer program stops the power supply from the capacitor 104 to the devices such as the communication unit 40. As described above, the target construction information T is updated to the new target construction information Tn while the excavator 100 is suspended. Therefore, when the operator turns the ignition key 103 ON and starts work after the update, the operator can start the work based on the new target construction information Tn, and thus the operator can efficiently proceed with the construction.

Further, when the operator of the excavator 100 operates the switch 29S to cancel the excavation control mode in a state of the excavation control mode under which the excavation control is being executed, the target construction information T that has been used in the excavation control mode is updated to the new target construction information Tn stored in the buffer, and the new target construction information Tn can be updated as the target construction information T in the storage unit 28M. Since there is an intension of cancellation of the excavation control mode by the operator, when the excavation control mode is activated after the excavation control mode is canceled by the above-described processing, the operator can operate the work machine 2 without feeling uncomfortable even if the excavation control is executed with the updated target construction information T.

The processing unit 28P of the display control device 28 may update the target construction information T to be used for the excavation control to the new target construction information Tn received by the communication unit 40 when the work machine control device 26 is executing the excavation control, and the bucket 8 of the work machine 2 is away from the object to be excavated. For example, the work machine control device 26P or the display control device 28 calculates a distance between the blade tip 8T of the bucket 8 and the object to be excavated, and as a result, the blade tip 8T of the bucket 8 is away from the object by a predetermined distance or more, the excavation control mode may be automatically canceled and the state becomes in a non-execution state of the excavation control, and the target construction information T may be updated to the new target construction information Tn received by the communication unit 40. Here, a distance between a predetermined position of the work machine 2 and the object to be excavated may be calculated instead of the distance between the position of the blade tip 8T of the bucket 8 and the object to be excavated. As described above, when the bucket 8 or the work machine 2 is away from the object to be excavated, the excavation control is not executed. Therefore, even if the target construction information T in the storage unit 28M is updated to the new target construction information Tn, the operator can operate the work machine 2 without feeling uncomfortable. Further, there is an advantage that the target construction information T in the storage unit 28M is promptly updated to the new target construction information Tn.

When the position information of the target construction information T being used for the excavation control and the position information of the new target construction information Tn received by the communication unit 40 can be considered the same, the processing unit 28P of the display control device 28 may update the target construction information T to be used for the excavation control to the new target construction information Tn received by the communication unit 40. In this case, the excavation control is executed based on the target excavation landform data Un generated from the new target construction information Tn that can be considered the same as the target construction information T. Therefore, the excavation control intervenes similarly to the case of using the target excavation landform data U generated from the target construction information T. As a result, in performing the computer-aided construction using the excavator 100, even if the target construction information T is updated to the new target construction information Tn that can be considered the same as the target construction information T, as described above, the target form of the object to be excavated is unchanged. Therefore, it is not the update that is not intended by the operator, and the operator can operate the work machine 2 without feeling uncomfortable. Further, as described above, when the position information of the obtained target construction information T and the position information of the new target construction information Tn can be considered the same, when the obtained target construction information T is updated to the new target construction information Tn, the operator of the excavator 100 can operate the work machine 2 without feeling uncomfortable. Further, there is an advantage that the target construction information T in the storage unit 28M is promptly updated to the new target construction information Tn.

Further, when the processing unit 28P of the display control device 28 is updating the target construction information T to be used for the excavation control to the new target construction information Tn received by the communication unit 40, even if there is a command to execute the excavation control, the work machine control device 26 may not execute the excavation control. In this way, in performing the computer-aided construction using the excavator 100, the update of the target construction information T that is not intended by the operator is not performed. Therefore, the operator can operate the work machine 2 without feeling uncomfortable.

The state of waiting for update to the new target construction information T_An during the excavation control by the work machine control device 26 includes the following cases. In addition to the state of holding the new target construction information T_An in a state of once storing the new information in the buffer, as described above, a state where the landform data generation unit 28C of the display control device 28 does not perform processing of obtaining the target excavation landform 43I or a state where, even if having performed the processing of obtaining the target excavation landform 43I, the landform data generation unit 28C does not perform update to the new target excavation landform 43I, even if having acquired the new target construction information T_An, are the states of waiting for update. Further, a state of not accepting the new target construction information T_An or target excavation landform 43I from an outside of the excavator 100 during execution of the excavation control is also the state of waiting for update. For example, a state of not accepting the new target construction information T_An even if the new information has been transmitted to the excavator 100 from an outside is the state of waiting for update. Further, for example, a state in which the target excavation landform 43I based on the new target construction information T_An is generated or stored in an external device such as the management server 111, and the target excavation landform 43I is not accepted even if the landform has been transmitted to the excavator 100 is also the state of waiting for update.

In this case, the new target excavation landform 43I having been transmitted to the excavator 100 becomes the new target construction information T_An. As described above, even if the new target construction information T_An or the new target excavation landform 43I necessary for generation of the target excavation landform 43I is directly transmitted from an outside of the excavator 100, the control system 200 may reject the reception of the target construction information T_An.

While the present embodiment has been described, the present embodiment is not limited by the above-described content. Further, the above-described configuration elements include matters easily arrived at by a person skilled in the art, matters substantially the same, and matters within the scope of equivalents. Further, the above-described configuration elements can be appropriately combined. Further, various omissions, replacements, changes of the configuration elements can be made without departing from the gist of the present embodiment. For example, the work machine 2 includes the boom 6, the arm 7, and the bucket 8 that is a work tool. However, the work tool attached to the work machine 2 is not limited thereto and is not limited to the bucket 8.

Further, in the present embodiment, the update control of the target construction information has been described, as illustrated in FIG. 16, taking the excavator 100 as an example. However, the update control of the target construction information can be realized with respect to a bulldozer or a motor grader that enables the excavation control capable of controlling the blade along the target excavation landform data U not to dig into and erode the target excavation landform data U, like the present embodiment, by using of necessary devices, such as the communication unit 40, the processing unit 28P, and the storage unit 28M. Thus, the operator can appropriately execute the operation of the work machine in the computer-aided construction.

REFERENCE SIGNS LIST

1 VEHICLE BODY
2 WORK MACHINE
3 UPPER SWING BODY
5 TRAVELING DEVICE
6 BOOM
7 ARM
8 BUCKET
8B BLADE
8T BLADE TIP
19 POSITION DETECTION UNIT
20 THREE-DIMENSIONAL POSITION SENSOR
21 and 22 ANTENNA
23 GLOBAL COORDINATE CALCULATION UNIT
25 OPERATION DEVICE
26 WORK MACHINE CONTROL DEVICE
27 CONTROL VALVE
28 DISPLAY CONTROL DEVICE
28M STORAGE UNIT
28P PROCESSING UNIT
29 DISPLAY UNIT
29S SWITCH
29I INPUT UNIT
35 ENGINE
36 and 37 HYDRAULIC PUMP
39 SENSOR CONTROL DEVICE
40 COMMUNICATION UNIT
41 TARGET CONSTRUCTION SURFACE
43I TARGET EXCAVATION LANDFORM
44 EXCAVATION OBJECT POSITION
52 TARGET SPEED DETERMINATION UNIT
53 DISTANCE ACQUISITION UNIT
54 SPEED LIMIT DETERMINATION UNIT
57 WORK MACHINE CONTROL UNIT

100 EXCAVATOR
103 IGNITION KEY
110 MANAGEMENT CENTER
111 MANAGEMENT SERVER
200 CONTROL SYSTEM

The invention claimed is:

1. A control system for controlling an excavating machine including a work machine, comprising:

a storage unit configured to store construction information that indicates a target form of an object to be excavated by the work machine;

a work machine control unit configured to execute control for controlling an operation of the work machine to construct the object based on the construction information;

a communication unit configured to receive new construction information which is to be updated from the stored construction information; and a processing unit configured to receive a command to execute the control, and stop updating the target form of the object to be constructed by the work machine upon receipt of the new construction information during execution of the control.

2. A control system of controlling an excavating machine including a work machine, the system comprising:

a storage unit configured to store construction information that indicates a target form of an object to be excavated by the work machine and is capable to be updated;

a work machine control unit configured to execute control for controlling an operation of the work machine to construct the object based on the construction information stored in the storage unit; and a processing unit configured to receive a command to perform one of an execution and the removal of the control, and determine whether to update the construction information to be used for the control by the work machine control unit to new construction information, as a function of a control state of the work machine control unit controlling the work machine.

3. The control system of an excavating machine according to claim 2, wherein, when the work machine control unit is executing the control, the processing unit does not update the construction information being used for the control to the new construction information.

4. The control system of an excavating machine according to claim 3, wherein in a case where the work machine control unit is executing the control, when a file name of the construction information being used for the control and a file name of the new construction information are the same, the processing unit does not update construction information to be used for the control to the new construction information.

5. The control system of an excavating machine according to claim 3, wherein in a case where the work machine control unit is executing the control, when position information of the construction information being used for the control and position information of the new construction information are the same, the processing unit does not update construction information to be used for the control to the new construction information.

6. The control system of an excavating machine according to claim 2, wherein in a case where the work machine control unit is executing the control, the processing unit updates the construction information other than the construction information being used for the control to the new construction information.

7. The control system of an excavating machine according to claim 2, wherein, when the work machine control unit does not execute the control, or the excavating machine is in a state of key-off, the processing unit updates the construction information to be used for the control to the new construction information.

8. The control system of an excavating machine according to claim 2, comprising:

a switch configured to select whether executing the control, wherein when the control is canceled with an operation of the switch after the control is executed with an operation of the switch, the construction information used for the control is updated to the new construction information.

9. The control system of an excavating machine according to claim 2, wherein, when the work machine control unit is executing the control, and the work machine is away from the object to be constructed, the processing unit updates the construction information to be used for the control to the new construction information.

10. The control system of an excavating machine according to claim 2, wherein, during execution of the control by the work machine control unit, the processing unit displays reception information indicating that the new construction information has been received in a display unit.

11. A control system of controlling an excavating machine including a work machine, the system comprising:

a storage unit configured to store construction information that is information related to an object to be excavated that is excavated by the work machine, and to update, when new construction information has been received, the stored construction information to the new construction information;

a work machine control unit configured to execute control for controlling an operation of the work machine to construct the object based on the construction information stored in the storage unit; and a processing unit configured to update the construction information to be used by the work machine control unit for the control to the new construction information when a command to remove the control has been received and the work machine control unit is not executing the control for controlling the work machine, wherein when a command to execute the control has been received and the work machine control unit is executing the control, the processing unit is configured not to update the construction information being used by the work machine control unit for the control of the work machine to the new construction information and is configured to update the construction information other than the construction information being used by the work machine control unit for the control of the work machine to the new construction information.

12. An excavating machine comprising the control system of an excavating machine according to any one of claim 11.

13. An excavating machine comprising the control system of an excavating machine according to claim 1.

14. An excavating machine comprising the control system of an excavating machine according to claim 2.

15. The control system of an excavating machine according to claim 2, wherein, when there is a command to execute the controlling operation during the construction information is being updated to a new construction information, the controlling operation based on the command is not executed.

* * * * *